US011097446B2

(12) United States Patent
Motz et al.

(10) Patent No.: US 11,097,446 B2
(45) Date of Patent: Aug. 24, 2021

(54) SYSTEM AND METHOD FOR MAKING TIED BLOCK MAT WITH BORDER

(71) Applicant: Motz Enterprises, Inc., Cincinnati, OH (US)

(72) Inventors: Matthew James Motz, Cincinnati, OH (US); Sean Robert Stallo, Cincinnati, OH (US)

(73) Assignee: MOTZ ENTERPRISES, INC., Cincinnati, OH (US)

( * ) Notice: Subject to any disclaimer, the term of this patent is extended or adjusted under 35 U.S.C. 154(b) by 0 days.

(21) Appl. No.: 16/440,094

(22) Filed: Jun. 13, 2019

(65) Prior Publication Data

US 2020/0391406 A1 Dec. 17, 2020

(51) Int. Cl.

*E02B 3/14* (2006.01)
*B28B 7/00* (2006.01)
(Continued)

(52) U.S. Cl.

CPC ..... *B28B 7/0029* (2013.01); *B28B 1/14* (2013.01); *B28B 7/0002* (2013.01); *B28B 23/00* (2013.01); *E02D 17/202* (2013.01); *E02B 3/121* (2013.01); *E02B 3/122* (2013.01); *E02B 3/123* (2013.01); *E02B 3/126* (2013.01);
(Continued)

(58) Field of Classification Search

CPC ..... E02D 17/202; E02D 17/205; E02B 3/121; E02B 3/126
See application file for complete search history.

(56) References Cited

U.S. PATENT DOCUMENTS 1,451,229 A 4/1923 Loudenslager
3,332,187 A 7/1967 Arcari
(Continued)

FOREIGN PATENT DOCUMENTS

AU 2015100623 6/2015
EP 0123737 11/1984
(Continued)

OTHER PUBLICATIONS

CA, Office Action, Canadian Patent Application No. 3,014,926 (dated Mar. 31, 2020).
(Continued)

*Primary Examiner* — Sean D Andrish
(74) *Attorney, Agent, or Firm* — Thompson Hine LLP

(57) ABSTRACT

In an exemplary embodiment, a system for making tied block mat with a border includes a mold having an array of mold cavities; and a hopper that receives a hardenable paste and is spaced from the mold to receive a sheet of mesh material therebetween, the hopper having an opening for depositing the hardenable paste into selected mold cavities, the hopper forming a filling zone with the mold wherein the hardenable paste flows through the opening into the selected mold cavities, and a blocked zone where the hardenable paste is prevented from entering other selected mold cavities of the mold; whereby the tied block mat is formed wherein the hardenable paste in the selected mold cavities becomes embedded in the sheet of mesh material in the filling zone, and a border is formed in the blocked zone where the hardenable paste is blocked from entering the other selected mold cavities.

7 Claims, 11 Drawing Sheets

(51) Int. Cl.

| | |
|---|---|
| ***B28B 23/00*** | (2006.01) |
| ***E02D 17/20*** | (2006.01) |
| ***B28B 1/14*** | (2006.01) |
| *E02B 3/12* | (2006.01) |

(52) U.S. Cl.
CPC ..... *E02D 2250/0007* (2013.01); *E02D 2250/0023* (2013.01); *E02D 2250/0038* (2013.01); *E02D 2300/002* (2013.01); *E02D 2300/0006* (2013.01); *E02D 2600/20* (2013.01)

(56) References Cited

U.S. PATENT DOCUMENTS

| | | | | |
|---|---|---|---|---|
| 3,477,108 | A | 11/1969 | Stokes | |
| 3,597,928 | A * | 8/1971 | Pilaar | A01G 13/0268 405/20 |
| 3,720,493 | A | 3/1973 | Borcoman et al. | |
| 3,970,204 | A | 7/1976 | Lutz | |
| 3,981,669 | A | 9/1976 | Gambill et al. | |
| 4,311,273 | A | 1/1982 | Marsh | |
| 4,475,648 | A | 10/1984 | Weeks | |
| 4,859,516 | A | 8/1989 | Yamanaka et al. | |
| 5,039,250 | A | 8/1991 | Janz | |
| 5,048,640 | A | 9/1991 | McConville et al. | |
| 5,064,584 | A | 11/1991 | Jefferies | |
| 5,082,397 | A | 1/1992 | Raviv | |
| 5,443,329 | A | 8/1995 | de Geeter | |
| 5,501,753 | A | 3/1996 | Stark | |
| 5,554,393 | A | 9/1996 | Uchida et al. | |
| 5,911,539 | A | 6/1999 | Egan | |
| 6,095,320 | A | 8/2000 | DeMong et al. | |
| 6,517,294 | B2 | 2/2003 | Vreeland | |
| 6,793,858 | B2 | 9/2004 | Motz | |
| 6,945,739 | B1 | 9/2005 | Putnam | |
| 7,634,877 | B2 | 12/2009 | Wiercinski | |
| 10,161,094 | B2 | 12/2018 | Motz | |
| 2001/0053310 | A1* | 12/2001 | Brown | E02B 3/14 404/32 |
| 2002/0180076 | A1 | 12/2002 | Motz | |
| 2011/0042844 | A1 | 2/2011 | Brown et al. | |
| 2012/0243949 | A1* | 9/2012 | Schneider | E02D 17/202 405/302.7 |
| 2013/0101354 | A1 | 4/2013 | Lignier | |

FOREIGN PATENT DOCUMENTS

| | | | |
|---|---|---|---|
| EP | 0192861 | A1 | 9/1986 |
| FR | 2261873 | | 9/1975 |
| JP | 2-308061 | | 12/1990 |
| KR | 20050019161 | | 3/2005 |
| WO | 2011/0134476 | | 11/2011 |

OTHER PUBLICATIONS

U.S., Notice of Allowance, U.S. Appl. No. 16/277,540 (dated May 28, 2020).
U.S., Office Action, U.S. Appl. No. 16/277,540 (dated Jan. 9, 2020).
Australian Patent Office, Examination Report No. 1 issued for Australian Patent Application No. 2019204830, 5 pages (dated Aug. 7, 2020).
PCT, International Search Report and Written Opinion, International Application No. PCT/US2017/018122, 12 pages (dated Jun. 19, 2017).
Webpage featuring "Recyclex® TRM and Recyclex® TRM-V," by American Excelsior Company, http://americanexcelsior.com/product/?sub=15 (retrieved from the internet on Aug. 25, 2015).
U.S., Office Action, U.S. Appl. No. 15/048,539 (dated Nov. 2, 2017).
U.S., Office Action, U.S. Appl. No. 15/048,539 (dated Jun. 26, 2018).
U.S., Notice of Allowance, U.S. Appl. No. 15/048,539 (dated Nov. 15, 2018).
Product Overview featuring "High Performance Geosynthetics", by Enka® Solutions (Aug. 2016).
PCT, International Search Report and Written Opinion, International Application No. PCT/US2017/023710, 13 pages (dated Jun. 16, 2017).
EP, Search Report, European Application No. 17753813.9, 7 pages (dated Aug. 26, 2019).
Product Overview featuring Fornit® 30/30, by Huesker Engineering with Geosynthetics, 1 page (at least as early as Apr. 17, 2018).
CA, Notice of Allowance, Canadian Patent Application No. 3,014,296 (dated Jul. 8, 2019).
U.S., Notice of Allowance, U.S. Appl. No. 15/467,516 (dated Nov. 5, 2018).
U.S., Office Action, U.S. Appl. No. 15/467,516 (dated Sep. 13, 2018).
U.S., Advisory Action, U.S. Appl. No. 15/467,516 (dated Sep. 4, 2018).
U.S., Office Action, U.S. Appl. No. 15/467,516 (dated May 11, 2018).
U.S., Office Action, U.S. Appl. No. 15/467,516 (dated Jan. 12, 2018).
AU, Examination Report No. 1, Australian Application No. 2017238225 (dated Mar. 5, 2019).
CA, Office Action, Canadian Application No. 3,018,841 (dated Mar. 29, 2019).
AU, Notice of Acceptance, Australian Application No. 2017238225 (dated Jun. 24, 2019).
EP, Search Report, European Application No. 17771110.8, 7 pages (dated Aug. 29, 2019).
AU, Notice of Acceptance, Australian Application No. 2017257882 (dated Sep. 13, 2019).
CA, Office Action, Canadian Patent Application No. 3,018,841 (dated Oct. 18, 2019).
European Patent Office, European Search Report and European Search Opinion, European Patent Application No. 20157246.8, 11 pages (dated Jul. 17, 2020).
CA, Office Action; Canadian Intellectual Property Office; Patent Application Serial No. 3,014,926, 4 pages (dated Oct. 9, 2020).

* cited by examiner

SYSTEM AND METHOD FOR MAKING TIED BLOCK MAT WITH BORDER

TECHNICAL FIELD

The present disclosure relates to systems and methods for forming flexible tied block mats, and more particularly, to systems and methods for forming continuous flexible tied block erosion control mats.

BACKGROUND

Erosion is a natural process in which meteorological elements such as rain, wind, and snow remove soil, rock, and dissolved material from one location on the Earth's crust and transport it to another location. While such erosion is a natural process, certain localized human activity increases the rate of erosion to many times that at which erosion occurs naturally. Land surfaces adjacent man-made structures such as canals, roads, reservoirs and ponds, and artificially created drainage channels and other waterways are particularly susceptible to erosion because naturally occurring indigenous vegetation is removed in order to form the structures.

Erosion can be mitigated in these areas by remediation of the land surface adjacent the canal, road, or channel by planting vegetation to replace the vegetation that was stripped away during construction. However, there is a time interval between the planting of the replacement vegetation and the point at which the replacement vegetation is sufficiently developed to prevent further erosion of surface soil during which further erosion may occur.

Efforts have been made to retain the surface soil in place in these areas until such time as vegetation can mature to the point where the root structure of the vegetation retains the soil in place. An example of such material is the flexible mat structure disclosed in U.S. Pat. No. 6,793,858 titled "Method and Apparatus for Forming a Flexible Mat Defined by Interconnected Concrete Panels," the entire contents of which are incorporated herein by reference. That patent discloses a flexible mat structure in the form of spaced, interconnected concrete panels or blocks cast into and held together on a sheet of an open mesh of a polymeric material.

The flexible tied block mat structure may be made by depositing concrete in the block-shaped mold cavities formed in the surface of a rotating drum and embedding in the concrete material in oblong sheets of the open mesh. Alternatively, concrete may be deposited in an array or matrix of molds formed in a static, horizontal plate and covered with a correspondingly shaped sheet of geogrid mesh. The sheets of tied block mat are then rolled up, transported to the site where the sheets are to be installed, and there unrolled in parallel strips.

To form a continuous mat over the entire area of installation, it is necessary to attach adjacent sheets of tied block mat to each other along their adjacent edges. This attachment may be effected by digging a trench along an edge of a length of a first sheet such that the column or row of blocks along an edge of the sheet of tied block mat are sunk to ground height within the trench. The adjacent column or row of blocks along the adjacent edge of the adjacent sheet is placed on top of the sunk blocks so that the adjacent sheets are held together by the weight of the upper longitudinal column of blocks upon the longitudinal column of blocks of the adjacent sheet sunk beneath them.

Additional means of attachment involve mechanically connecting the adjacent sheets of tied block mat to each other, and optionally to the ground beneath them. Forms of mechanical attachment include looping stainless steel cable ties through geogrid openings in adjacent or overlapping edges of tied block mat, and inverted U-shaped metal anchors with legs extending through openings in the geogrid of adjacent tied block mat and into the ground.

A disadvantage of such a connecting process is that time and labor are required to dig trenches between adjacent sheets of tied block material. Accordingly, there is a need for a more efficient method and device to connect adjacent sheets of tied block mat.

SUMMARY

The present disclosure describes a system and method for forming tied block mat that facilitates the connection of adjacent sheets of tied block mat to each other in an efficient and cost-effective manner. The disclosed system and method eliminate the need for digging a trench along a length of a sheet of tied block mat in order to secure adjacent sheets to each other.

In one embodiment, a system for making tied block mat with a border includes a mold having an array of mold cavities; and a hopper that receives a hardenable paste and is spaced from the mold sufficiently to receive a sheet of mesh material therebetween, the hopper having an opening for depositing the hardenable paste into selected mold cavities of the array of mold cavities. The hopper forms a filling zone with the mold wherein the hardenable paste flows through the opening into the selected mold cavities, and a blocked zone with the mold where the hardenable paste in the hopper is prevented from entering other selected mold cavities of the mold. The tied block mat is formed wherein the hardenable paste in the selected mold cavities becomes embedded in the sheet of mesh material in the filling zone, and a border is formed in the blocked zone where the hardenable paste is blocked from entering the other selected mold cavities.

In another embodiment, a tied block mat includes a sheet of grid material; and a plurality of blocks of hardened material connected to the sheet and arranged thereon to form a longitudinal strip along an edge of the sheet that is free of the blocks, wherein the longitudinal strip of the sheet has a width of at least a width of one block.

Yet another embodiment is a method of connecting first and second sheets of tied block mat, each sheet of tied block mat having a sheet of grid material and a plurality of blocks of hardened material connected to the sheet of grid material. The method includes arranging the blocks on the first sheet of tied block mat to form a longitudinal strip along an edge of the first sheet of grid material that is free of the blocks; placing the first sheet of tied block mat on a support surface; and placing the second sheet of tied block mat on the support surface adjacent the longitudinal strip of the first sheet of tied block mat such that an edge of the second sheet of tied block mat overlies the longitudinal strip of the first sheet of tied block mat so that ones of the blocks of the second sheet are positioned above the strip of the first sheet of tied block mat to form an overlapping region.

Still another embodiment is a method for making tied block mat with a border. That method includes placing a sheet of mesh material over a mold having an array of mold cavities; depositing a hardenable paste into a hopper that spaced from a mold sufficiently to receive the sheet of mesh material therebetween; depositing the hardenable paste through an opening in the hopper into selected mold cavities of the array of mold cavities in a filling zone; preventing the hardenable paste from entering other selected mold cavities in a blocked zone; embedding the sheet of mesh material in the hardenable paste in the selected mold cavities in the filling zone; forming the border in the blocked zone where the hardenable paste is prevented from entering the other selected mold cavities; and hardening the hardenable paste to form the tied block mat.

Other objects and advantages of the disclosed flexible mat forming system will be apparent from the following description, the accompanying drawings, and the appended claims.

DETAILED DESCRIPTION

Figure 1:
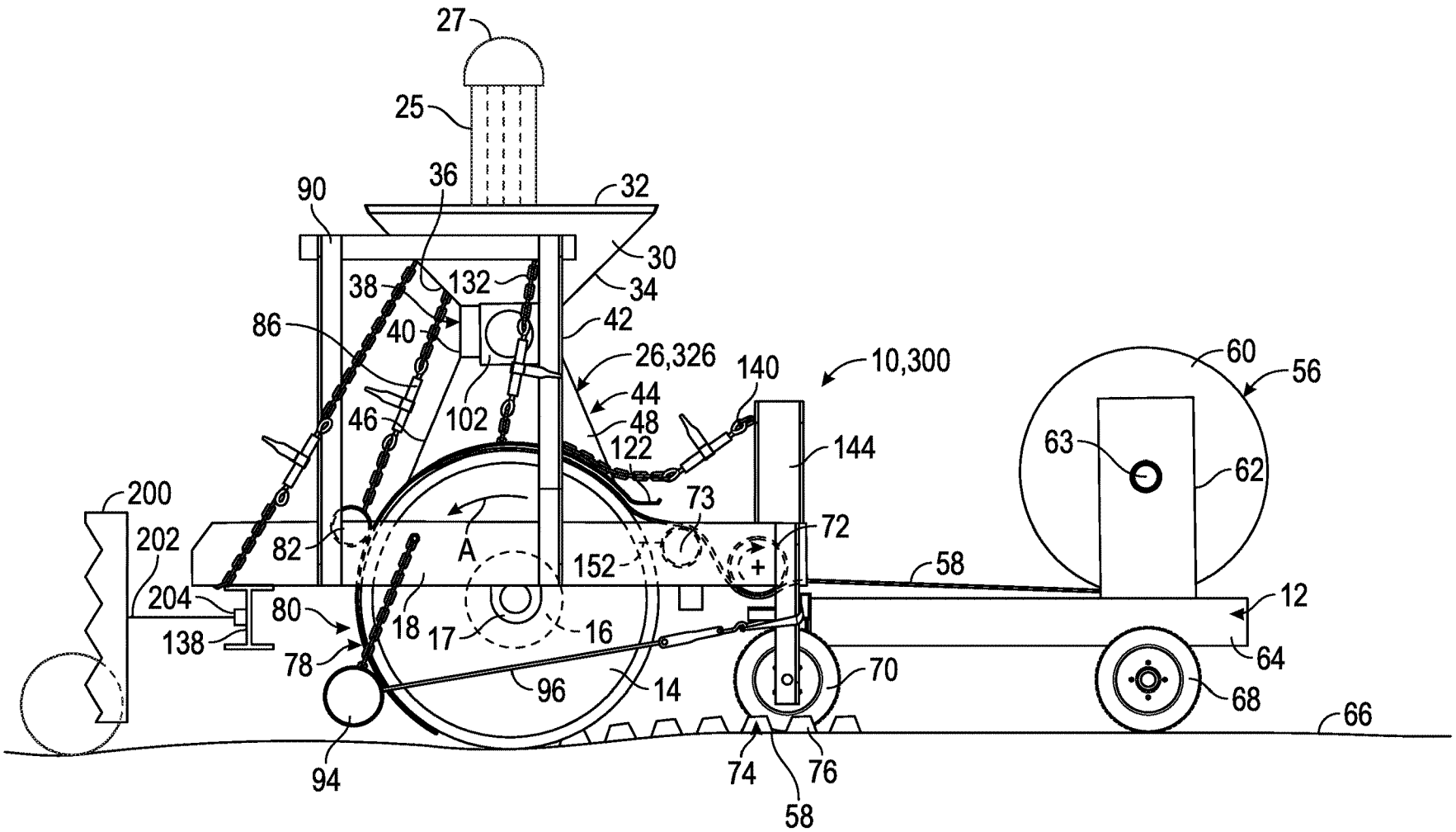
FIG. 1 is a schematic, side elevational view of an embodiment of the disclosed flexible mat forming system.
Figure 2:
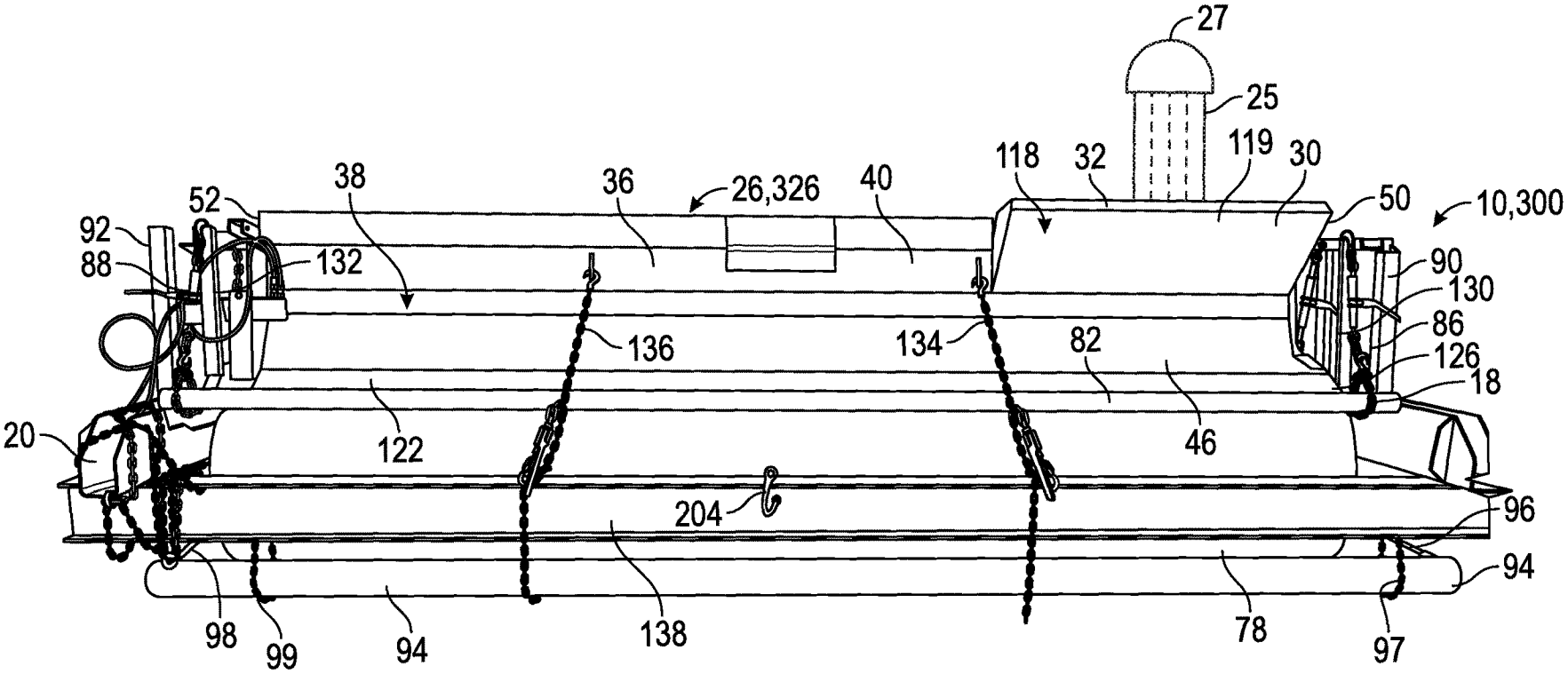
FIG. 2 is a schematic, front elevational view of the flexible mat forming system of FIG. 1.
Figure 3:
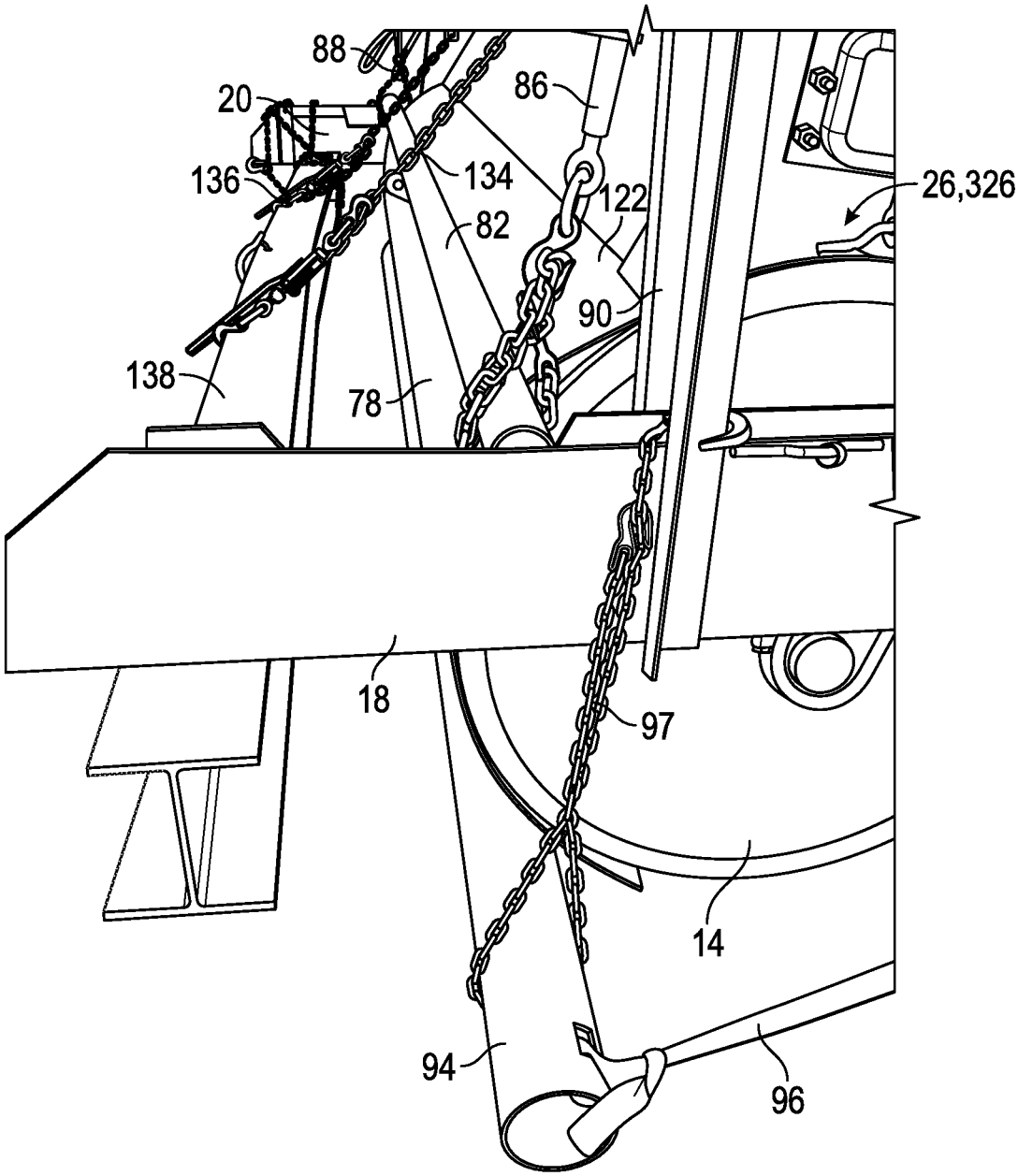
FIG. 3 is a detail perspective view of the flexible mat forming system of FIG. 1, showing the retaining plate.
Figure 4:
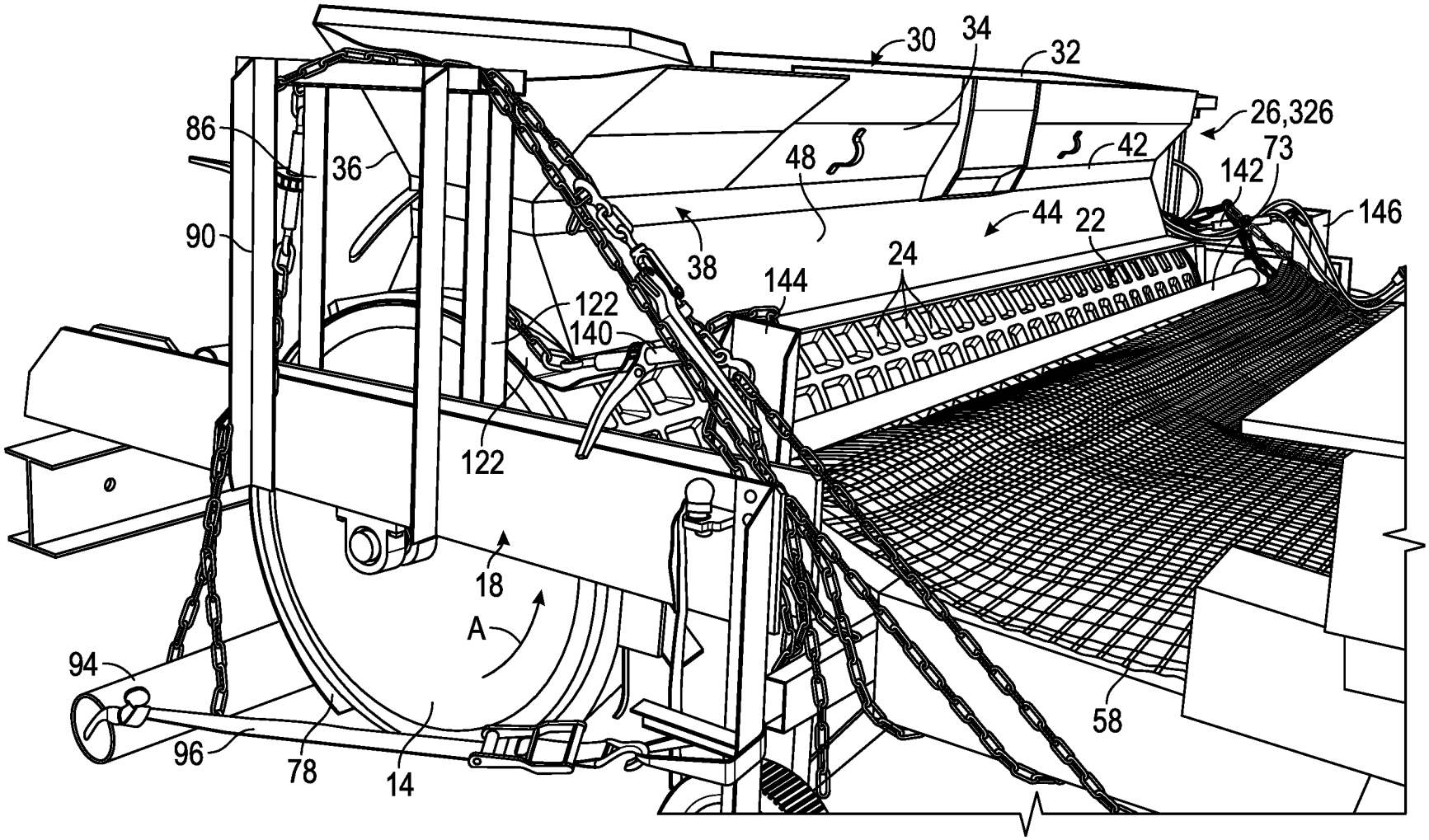
FIG. 4 is a perspective view of the flexible mat forming system of FIG. 1, taken from the rear of the hopper and drum.

The disclosed flexible mat forming system, generally designated 10, is shown in FIGS. 1, 2, and 4. In an exemplary embodiment, the system 10 includes a frame 12 on which is mounted a mold having an array of mold cavities. In an embodiment, the mold takes the form of an elongate, rotatable cylindrical drum 14. The drum 14 may be rotated by a motor 16, which in embodiments may be an electric motor or a hydraulic motor, in which case the system 10 is self-propelled, or assists in propelling itself. The motor 16 may rotate the drum in a counterclockwise direction, as indicated by arrow A in FIGS. 1 and 4. In other embodiments, system 10 does not have a motor 16, but instead the drum 14 rests on the ground 66 and rotates in the direction of arrow A as a result of friction with the ground from the frame 12 being pulled over the ground, which in FIG. 1 would be to the left. In an embodiment, the frame 12 may include a pair of horizontal beams 18, 20 on which the drum 14 is rotatably mounted, for example by a journal bearing 17.

As shown in FIG. 4, in an exemplary embodiment, the drum 14 includes an array 22 of mold cavities 24, which in embodiments are in transverse rows, that are formed about the outer periphery, or cylindrical outer surface, of the drum. In other embodiments, the array 22 is of mold cavities 24 arranged in a pattern or patterns on the drum. In embodiments, the patterns are selected from a rectilinear, transverse row of the mold cavities, a staggered pattern of the mold cavities, a checked pattern of the mold cavities, a random pattern of the mold cavities, a running bond pattern of the mold cavities, and combinations of the foregoing. With such embodiments, the term transverse row 22, as used herein, includes any spacing or arrangement or pattern of the mold cavities 24 along the length of the outer periphery of the drum 14, including the aforementioned patterns, and is not limited to a rectilinear row parallel to a central rotational axis of the drum 14.

Accordingly, the drum 14, which in embodiments takes the form of an elongated cylinder, is a form having mold cavities 24. In embodiments, the mold cavities 24 are shaped to receive hardenable paste 25 from a chute 27 (see FIGS. 1 and 2) from the drum of a concrete transport truck, or from a concrete pump, or from a concrete mixer trailer, and form the hardenable paste 25 blocks 76, which in embodiments may be square at their base. For example, the mold cavities 24 may be shaped to form pyramidal blocks 76 of hardenable paste 25 received from the hopper 26 having square bases 6½"×6½" and 2¼" high, although the mold cavities may have other shapes and dimensions. For example, the mold cavities 24 may be shaped to form blocks 76 having shapes selected from rectangular, square, hexagonal, octagonal, round, elliptical, irregular, and combinations of the foregoing.

As shown in FIGS. 1, 2, and 4, in embodiments, the system 10 includes an elongate hopper, generally designated 26, adjacent the drum 14. In an embodiment, the hopper 26 is positioned directly above the drum at the 12 o'clock position (i.e., above the highest vertical point of the circular end of the drum 14 as shown in FIG. 1), such that the hopper is positioned above an uppermost one of the plurality of rows 22 of mold cavities 24. In other embodiments, the hopper 26 is positioned relative to the drum 14 upstream of the 12 o'clock position, for example at the 2 o'clock position, and in still other embodiments, the hopper is positioned relative to the drum 14 downstream of the 12 o'clock position, for example at the 10 o'clock position. In other embodiments, the hopper 26 is positioned adjacent the drum 14 in locations between the 3 o'clock position and the 9 o'clock position.

In an embodiment, the hopper 26 is shaped to receive a hardenable paste 25 and deposit the hardenable paste into mold cavities 24 facing the hopper. In an embodiment in which the mold cavities 24 are arranged in rectilinear transverse rows 22, the hopper 26 deposits the hardenable paste 25 along a facing row 28 (see FIG. 7) of the plurality of transverse rows 22 of mold cavities 24. In an embodiment, the hopper 26 includes an open upper portion 30 having an open top 32 and downwardly extending and converging front and rear walls 34, 36, respectively. In embodiments, the hopper 26 includes a filling zone or central section 38 having front and rear walls 40, 42, respectively, shaped to form a trough with an arcuate bottom, and a lower section 44 having downwardly and outwardly diverging front and rear walls 46, 48, respectively.

Figure 5:
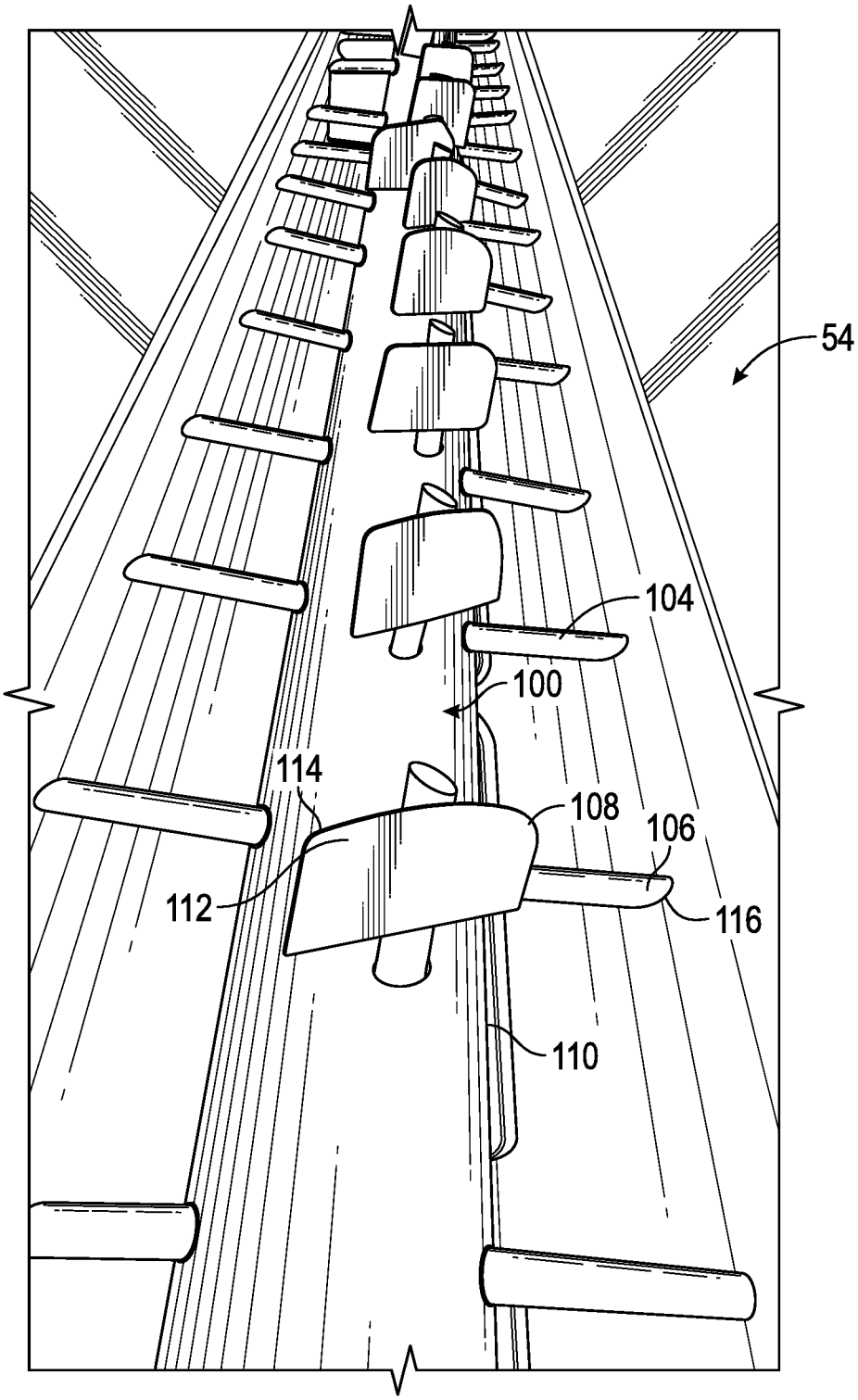
FIG. 5 is a detail showing an embodiment of a rotating auger located within the hopper of the flexible mat forming system of FIG. 1.
Figure 6:
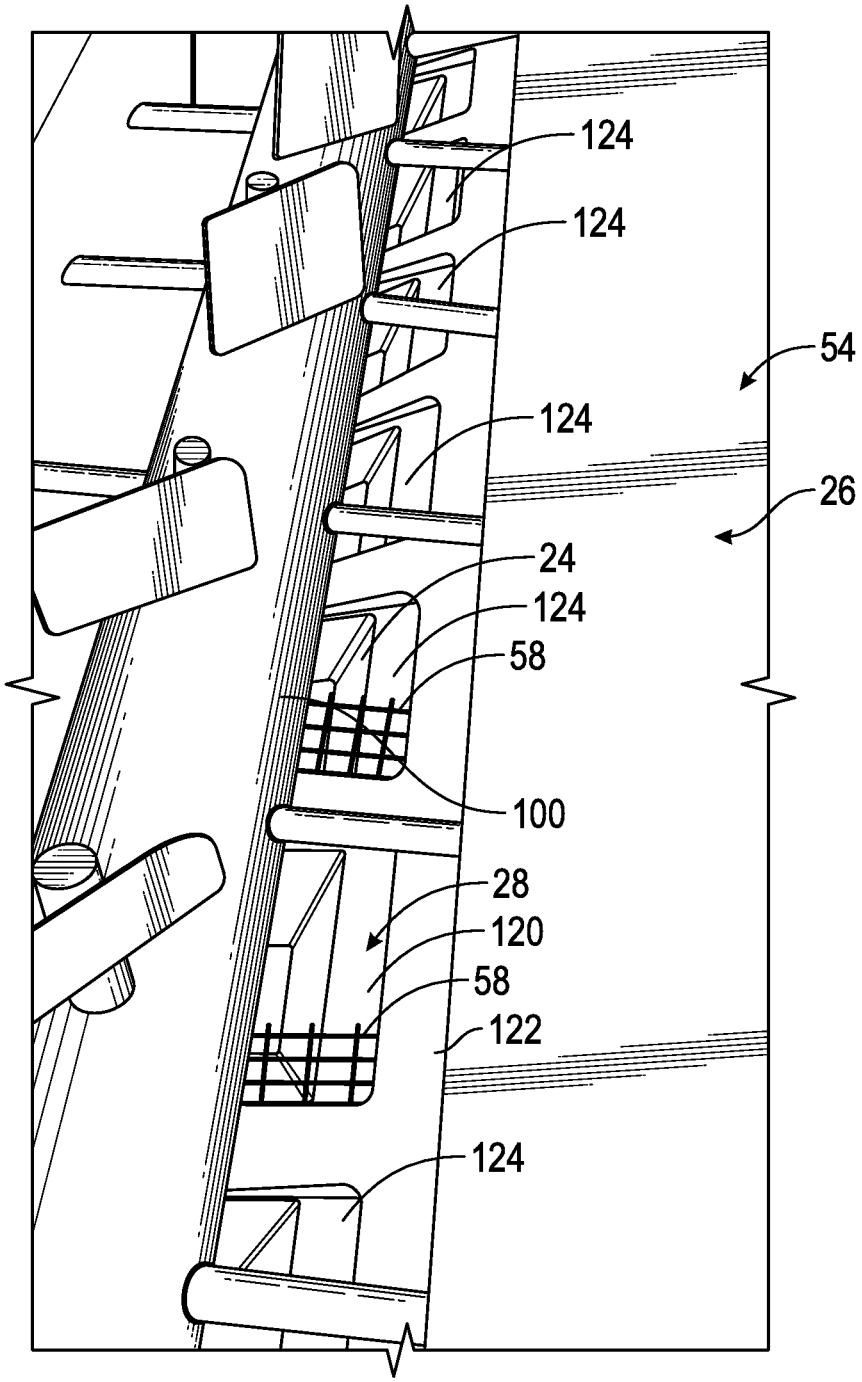
FIG. 6 is a detail perspective view of a section of the hopper of FIG. 5.

Front and rear walls 34, 36 of the hopper 26 define frontward and rearward facing surfaces, respectively. Front and rear walls 40, 42 define forward and rearward facing walls, respectively, and walls 48, 46 define forward and rearward facing walls, respectively. The front and rear walls 34, 36, 40, 42, 46, 48 are closed by opposing end walls 50, 52 to define an interior chamber 54, as shown in FIGS. 5 and 6. In embodiments, the hopper 26 includes a bottom panel 122 that in some embodiments is shaped to conform to the curvature of the outer periphery of the drum 14. As will be described, in embodiments the arcuate shape of the bottom panel 122 may support the remainder of the hopper 26 on top of the drum 14, and in other embodiments, permit a close spacing between the hopper and the top of the drum.

In embodiments, the system 10 includes a support, generally designated 56, which takes the form of a spool assembly having a spindle or rotating axle, for supporting a sheet 58 of a mesh material, from a roll 60 on the spool assembly 56, between the hopper 26 and the facing row 28 (see FIG. 7) of the plurality of transverse rows 22 of mold cavities 24. In embodiments, the spool assembly 56 includes a pair of posts 62 to which a spindle or axle 63 is attached and extends therebetween. In embodiments, the support 56 is mounted on a rear platform 64 of the frame 12. In an exemplary embodiment, the rear platform 64 is supported above the ground 66 by a pair of rear wheels 68 and a pair of front wheels 70. In embodiments, the spindle 63 is mounted on the posts 62 for free rotation relative to the support; in other embodiments the spindle is motorized to assist in paying out the sheet 58.

The sheet 58 of mesh material may, in an embodiment, be a sheet of open mesh material, and in other embodiments be a sheet of a polymer mesh, which may be a bi-axial geogrid material such as polyester or polypropylene. An example of such a polypropylene mesh is Fornit 30/30 geogrid manufactured by Huesker Inc. of Charlotte, N.C. In an embodiment, the sheet 58 of mesh material may be fed forwardly, that is, to the left in FIG. 1, under guide tube 72, which is mounted on the frame 12 and extends transversely adjacent the drum 14, and either over or under a second transverse guide tube 73, where it continues, passing beneath the hopper 26 and above the drum 14.

A hardenable paste 25 is deposited into the open top 32 of the hopper 26 in the filling zone or central section 38, and in an exemplary embodiment falls downwardly through the hopper and into the facing row 28 of the plurality of transverse rows 22 where it is retained within the mold cavities 24. In embodiments, the hardenable paste 25 is a fresh cement paste such as Portland cement, and in a particular embodiment is 5000 psi. wet-cast Portland cement. In other embodiments, the hardenable paste 25 is selected from concrete, a polymer, and mixtures of Portland cement, sand and/or gravel, and a polymer. The sheet 58 of mesh material becomes embedded in the hardenable paste 25 and the combination of mesh and paste continues as the drum 14 rotates in the direction of arrow A in a downstream direction away from the hopper 26 where the paste hardens and the combination of mesh and paste leaves the lower portion of the drum 14 as a flexible mat, generally designated 74, of blocks 76 of hardened paste material held together by the sheet 58 of geogrid mesh, also known as a tied concrete (i.e., hydraulic Portland cement) block mat when concrete is used as the hardenable paste 25. A sheet of such a tied block mat is suitable for applying to the ground for purposes of erosion control.

As shown in FIGS. 1, 2, 3, and 4, in an embodiment, a retaining plate, generally designated 78, extends partially about the outer periphery of the drum 14 and is positioned on the downstream side 80 of the drum and hopper 26. The retaining plate 78 may be spaced sufficiently close to the outer periphery of the drum to retain the sheet 58 of mesh material against the outer periphery of the drum and the hardenable paste 25 within the mold cavities 24 passing between the retaining plate and the outer periphery of the drum 14.

In an embodiment, the retaining plate 78 may be shaped to conform to the curvature of the outer periphery of the drum 14. Also in an embodiment, the retaining plate may be imperforate, comprising a single sheet of curved sheet metal. In other embodiments, the retaining plate 78 is made of an aluminum alloy, or a woven or nonwoven mat of a geosynthetic, such as polypropylene, a nylon, other polymers, a polyamide material, or combinations of the foregoing. In the embodiment shown in FIGS. 1-4, the frame 12 supports the drum 14 and hopper 26, and the hopper is positioned above an uppermost one of the plurality of transverse rows 22 of mold cavities 24. Further, the retaining plate 78 may be attached to the frame 12.

The retaining plate 78 may include an upper retaining member, generally designated 82, that may be attached to the frame 12 for holding an upper portion of the retaining plate 78 against the outer periphery of the drum 14. The upper retaining member 82 may include an adjustable connection, which may take the form of adjustable cables or chains 86, 88 having ratchets incorporated therein for manually lengthening and shortening their lengths. The adjustable cables or chains 86, 88 may extend from their upper ends, which may be attached to upright supports 90, 92 of the frame 12 and are attached at their lower ends to the upper retaining member 82.

By adjusting the lengths of the cables or chains 86, 88, the spacing between the retaining plate 78 and the hopper 26 is adjusted. Further, the spacing between the outer periphery of the drum 14 and the retaining plate 78 is varied by adjusting the lengths of the cables or chains 86, 88. In an embodiment, the upper retaining member 82 may take the form of an upper retaining bar extending transversely of the retaining plate 78. Another function of the adjustable cables or chains 86, 88 is that they may be lengthened or shortened to adjust the height of the retaining plate 78 above the ground 66. This enables the point at which the flexible mat 74 is no longer held against the outer periphery of the drum 14 and may begin to separate from the drum.

As shown in FIGS. 1-4, the system 10 may include a lower retaining member 94 that holds a lower portion of the retaining plate 78 against the outer periphery of the drum 14. The lower retaining member 94 may urge a lower edge of the retaining plate 78 against the drum 14 outer periphery. In an embodiment, the lower retaining member 94 may take the form of a lower retaining bar or a round pipe that extends transversely of the retaining plate 78. The lower retaining member 94 may include left and right adjustment arms 96, 98. The adjustment arms 96, 98 may be attached to the frame 12 and be adjustable in length to vary a force exerted by the lower retaining member 94 against the retaining plate 78, and thus the force exerted by the retaining plate against a lower portion of the outer periphery of the drum 14. The adjustment arms 96, 98 may take the form a pair of adjustable straps, each attached to the frame 12.

In embodiments, the lower retaining member 94 may not be attached to the retaining plate 78, but only urged against it, thereby allowing relative slidable movement between the lower retaining member and the shield, for example, in response to height adjustment by cables or chains 86, 88. In such an embodiment, support chains 97, 99, each extending between and interconnecting the lower retaining member 94 and the upright supports 90, 92 of the frame 12, may support the lower retaining member 94 at a pre-set, desired height above the ground 66 and relative to the retaining plate 78.

As shown in FIGS. 1 and 2, in an embodiment the retaining plate 78 operates to hold the sheet 58 of mesh material, which in an embodiment may be a geogrid or other geosynthetic material, against the outer periphery of the drum 14 as the mesh material and rows 22 of mold cavities 24 pass beneath the hopper 26 in a downstream direction, indicated by arrow A, away from the hopper and extend downwardly toward the ground 66. As the rows of mold cavities 24 pass downstream of the hopper 26, they receive a hardenable paste 25, which in an embodiment may be fresh (i.e., flowable and not yet hardened) cement paste, and the sheet 58 of geogrid mesh material may become embedded in the fresh cement paste, and the cement paste hardens as the drum 14 rotates the combination mesh and cement paste between the retaining plate 78 and drum 14. At the lowermost portion of the drum 14, the paste 25 has hardened, in embodiments at least enough to be dimensionally stable, forming the mesh and block combination 74, also known as a tied concrete block mat, shown in FIG. 1. In embodiments, the paste 25 is formulated to continue to harden after the paste leaves the mold cavities 24 as shown in FIG. 1.

As shown in FIGS. 1, 5, and 6, in an embodiment the hopper 26 includes an auger, generally designated 100, that is positioned in the central section 38 of the hopper. The auger 100 may be rotated by a motor 102 and functions to distribute a hardenable paste 25, such as fresh cement paste, along a length of the hopper 26. In an embodiment, the auger 100 is co-extensive with the length of the facing row 28 of the plurality of transverse rows 22 of mold cavities 24. In an embodiment, the auger 100 includes a plurality of radially extending protrusions, generally designated 104, along its length. In an embodiment, the protrusions include radially extending rods 106 and radially extending paddles 108 arranged alternately along a central shaft 110. In an embodiment, the rods 106 and paddles 108 extend radially from the central shaft 110 and are spaced about the periphery of the central shaft. In an embodiment, the central shaft 110 may be rotatably mounted in the end walls 50, 52 of the hopper 26 (see FIG. 2).

In an exemplary embodiment, the paddles 108 include opposing flat surfaces 112, 114 that are generally planar in shape and are oriented perpendicular, or generally perpendicular, to a central rotational axis of the shaft 110, which is the same as the central axis of the tubular, rectilinear shaft. The surfaces 112, 114 of the paddles 108, are angled or skewed relative to the central axis of the shaft 110 to displace fresh cement paste deposited in an end of the hopper 26, along its length, to an opposite end of the hopper when the auger 104 is rotated, for example, clockwise as shown in FIGS. 5 and 6. In embodiments, the rods 106 include beveled ends 116 angled to provide close clearance with the curved inner surface of the hopper 26, in contrast to squared or rounded ends.

With the auger 100, the hopper 26 may be loaded with cement paste 25 at a filling end 118 (FIG. 2) that may be defined by an enlarged feed chute 119. There is no need to distribute hardenable paste 25, such as fresh cement paste, along the entire width of the open top 32 of the hopper 26. Instead, fresh cement paste may be deposited in only a portion, or in embodiments at a single location, of the hopper 26, for example, into the enlarged feed chute 119, and the auger 100 is rotated by the motor 102 so that the angled paddles 108 rotate in the paste to urge and distribute the paste along the length of the hopper 26, whereupon it falls into the mold cavities 24 of the drum 14 through an opening 120. In an embodiment, the opening 120 is formed in the bottom panel 122. In embodiments, the opening 120 takes the form of a continuous slot; in other embodiments, the opening 120 takes the form of discrete openings corresponding in shape and arrangement to the mold cavities 24 on the drum 14 (see FIGS. 5, 6, and 7).

In an embodiment, the paddles 108 may be distributed along the length of the auger 100 and may be attached to the central shaft 110 at regularly spaced intervals. Also in an embodiment, the paddles 108 are positioned along the length of the shaft 110 so that they are aligned with openings or slots 120 formed in the bottom panel 122 of the hopper 26 as shown in FIG. 6. As shown in FIGS. 5 and 6, in an embodiment the paddles 108 and rods 106 are arranged in alternating relation along the length of the shaft 110. In other embodiments, the paddles 108 may be angled to urge the paste from the center of the hopper 26 outwardly to both sides or opposite ends of the hopper. With such an embodiment, paste may be deposited in a central region of the hopper 26—that is, midway or approximately midway between the end walls 50, 52 of the hopper—and rotation of the central shaft 110 may cause the paddles 108 to urge the paste from the center of the hopper 26 to the ends of the hopper. In still other embodiments, the blades 108 may be angled to urge paste deposited into the top 32 at any location along the length of the hopper 26, and in an embodiment are angled to urge the paste toward the end walls 50, 52 of the hopper from the point at which the paste is deposited.

Figure 7:
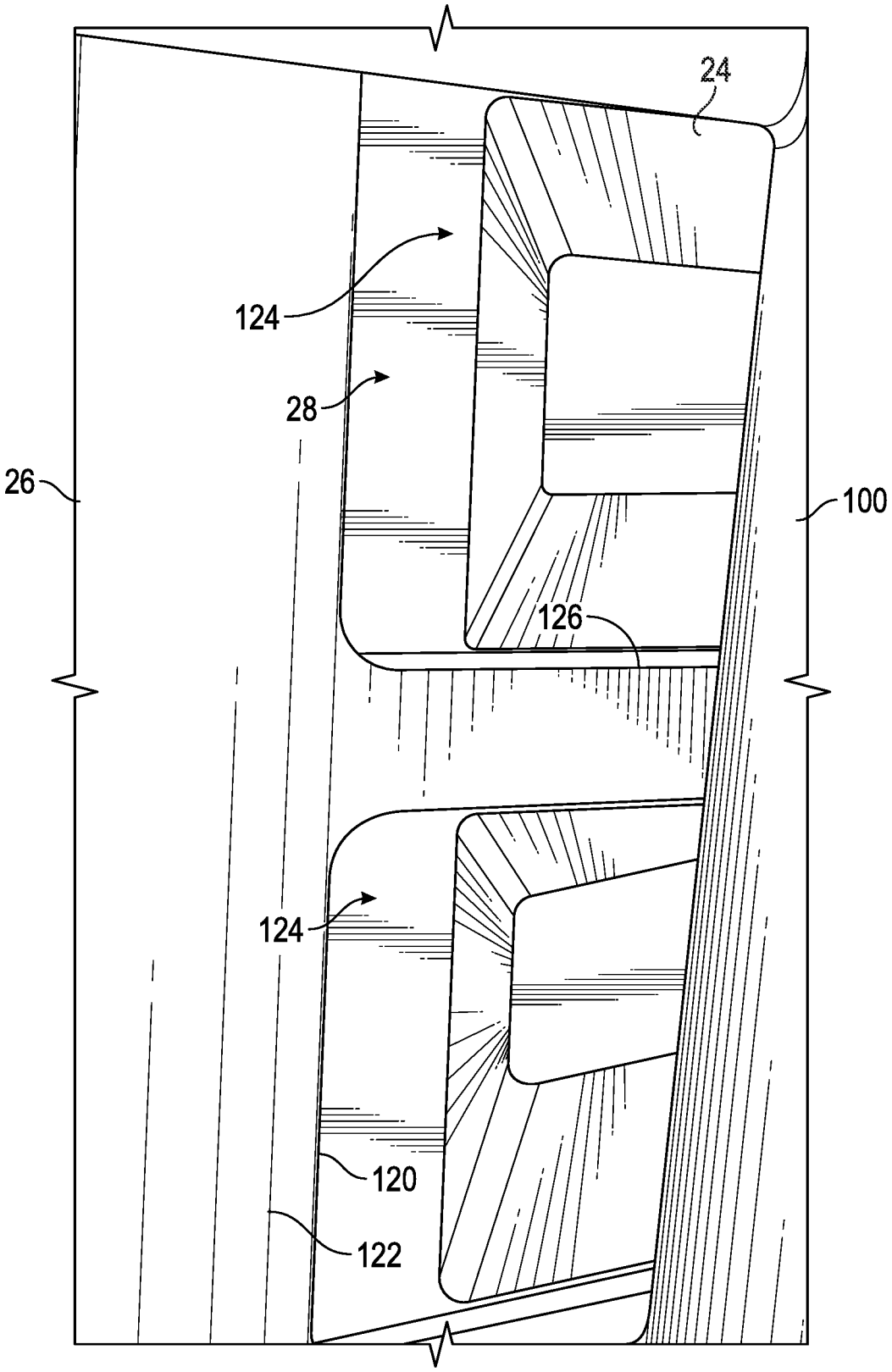
FIG. 7 is a detail perspective view showing a portion of the bottom plate of the hopper of the flexible mat forming system of FIG. 1.

As shown in FIGS. 5, 6, and 7, in an embodiment, the hopper 26 includes a bottom panel 122. In an embodiment, the bottom panel 122 has an arcuate shape corresponding to a curvature of the drum 14. In an embodiment, the bottom panel 122 has an opening that takes the form of spaced slots 120 that extend the length of the hopper 26. In an embodiment, the slots 120 may be shaped and positioned to align with the mold cavities 124 of the transverse row 22 of mold cavities (a subset of mold cavities 24 shown in FIGS. 4 and 8) of the facing row 28 of mold cavities of the drum 14. In an exemplary embodiment, the slots 120 are separated by dividers 126. In still other embodiments, the slots 120 have the same outer dimensions as at least some of the mold cavities 124 that come into alignment with them as the drum 14 rotates relative to the hopper 26. In other embodiments, the opening takes the form of a continuous, unbroken slot 120 that extends the entire length, or substantially the entire length, of the hopper 26 and is co-extensive with the arrangement of mold cavities 24 (FIG. 2) along the length of the drum 14. In still other embodiments, the opening is sized such that the slot 120 comprises the entire bottom of the hopper, eliminating the bottom panel 122.

An advantage of placing the slots 120 to align with the mold cavities 124 is that the alignment minimizes waste of the fresh cement paste 25 that is deposited in the hopper 26 by preventing fresh cement paste from being deposited between the mold cavities 124 on the outer periphery of the drum 14. As shown in FIGS. 5, 6, and 7, in an embodiment the plurality of slots 120 are arranged in a rectilinear row. In other embodiments, the slots make a non-linear pattern along, or partially along, the bottom panel 122. Each of the slots 120 may be of the same outer dimensions as the corresponding mold cavity 124 of the facing row of the plurality of rows 22 of mold cavities 24 formed on the outer periphery of the drum 14 that may pass beneath it as the drum 14 rotates.

As shown in FIGS. 1, 2, and 4, in an embodiment the hopper 26 is suspended from the supports 90, 92 of the frame 12. As shown in FIG. 2, in an embodiment the system 10 includes adjustable cables or chains 130, 132 that are attached to the support frames 90, 92 and extend downwardly to be attached to the panel 122 in the bottom of the hopper 26. To maintain the hopper 26 in position directly above the 12 o'clock position of the drum 14, in an embodiment the system 10 includes adjustable cables or chains 134, 136, that are attached at their upper ends to the upper portion 30 of the hopper 26 and extend downwardly to be attached at their lower ends to a transverse support beam 138 of the frame 12.

As shown in FIGS. 1 and 4, in an embodiment the hopper 26 is held in position above the uppermost portion of the drum 14 by adjustable cables or chains 140, 142 that are attached to posts 144, 146 of the frame 12. In an embodiment, the adjustable cables or chains 140, 142 also are lengthened and shortened to maintain the hopper 26 at the appropriate orientation above the drum 14. The clearance between the bottom panel 122 of the hopper 26 and the upper portion of the drum 14 is adjusted by appropriately lengthening or shortening the adjustable chains 130, 132 (see FIG. 2). With this structure, the hopper 26 may be suspended from the frame 12 to "float" above the upper portion of the drum 14, which in embodiments may be at approximately the 12 o'clock position, or in other embodiments, rest on the top of the drum 14 with a pre-set amount of weight force of the hopper.

The foregoing components of the system 10 for forming a flexible mat provide an efficient operation and minimize the waste produced. The frame 12 may be moved by a separate device, such as a tractor or truck, so that, as the drum 14 rotates to deposit the finished flexible mat 74, the mat material is laid out on the ground 66 as a continuous sheet. In an embodiment, as shown in FIG. 1, a tractor 200, which may take the form of a telehandler, may be connected to the transverse support beam 138 by a cable 202 connected to a ring 204. In that embodiment, the tractor 200 may pull the frame 12 of the system 10 to the left in FIG. 1 over the ground 66, which motion makes the drum 14 rotate in the direction of arrow A, pulling the mesh material 58 from the spool assembly 26, under guide tube 72, over second guide tube 73, and between the outer periphery of the drum 14 and the underside of the bottom panel 122.

As the sheet 58 of mesh material, shown partially removed in FIG. 6 for clarity, passes beneath the hopper 26, the hardenable paste 25, which has been deposited into the hopper 26 and distributed by the auger 100 along the length of the hopper, falls through the slots 120 into the cavities 124 (a subset of the cavities 24 shown in FIGS. 4 and 8) to fill the cavities. The sheet 58 of mesh material, which is held against the outer periphery of the drum 14 by the bottom panel 122 and the tension of the mesh being payed out from the spool assembly 56 and the pinch between the bottom of the drum and the ground 66, becomes embedded in the paste held in the cavities 124.

The combination of the sheet 58 of mesh material and paste is held against the outer periphery of the drum 14 and the paste within the cavities 124, 24 as the transverse row 22 of mold cavities 124 rotate forwardly of the bottom panel 122 by the retaining plate 78. By the time the transverse row 22 of mold cavities 124 rotates beneath the retaining plate 78, the paste has hardened sufficiently to retain its shape as it falls by gravity downwardly from the mold cavities to the ground 66, forming the flexible mat 74 (FIG. 1). Further hardening of the paste into the blocks 76 may occur after the flexible mat 74 has separated from the drum 14 and been laid on the ground 66. The finished flexible mat 74 may thereafter be rolled up and transported to a desired location, where it may then be unrolled to form an erosion barrier.

After the flexible mat 74 has separated from the mold cavities 24, further rotation of the drum 24 brings the now-empty mold cavities upwardly into contact with the protrusions 152 of the cleaning member 150, which scrape any hardened paste from the cavities 24 as they pass by the cleaning member. The cleaned cavities 24 then again pass beneath the hopper 26 to be overlaid with mesh material 58 and receive hardenable paste 25 from the hopper 26.

In an exemplary embodiment, the system 10 for making a flexible mat 74 includes a form or mold having a plurality of mold cavities 24, a bottom panel 122 having an opening 120, and a frame 12 that adjustably supports the panel above the plurality of mold cavities and aligns the opening with adjacent ones of the mold cavities. The frame 12 spaces the panel above the mold cavities 24 a distance sufficient to receive the sheet 58 of mesh material between the bottom panel 122 and the mold cavities. In the exemplary embodiment shown in FIG. 1, the form or mold is the drum 14 having the plurality of mold cavities 24 formed in its outer cylindrical surface. In embodiments, the opening 120 takes the form of a plurality of slots, as shown in FIG. 6. In embodiments, the bottom panel 122, which is a part of the hopper 26, is adjustably supported above the mold cavities 24 of the drum 14 by adjustable cables or chains 140, 142, and clearance between the bottom panel 122 of the hopper and the upper portion of the drum, and hence the spacing of the panel above the mold cavities, is adjusted by lengthening or shortening the chains 130, 132 as well.

In an exemplary embodiment of the method for making a flexible mat 74 using the system as described in the previous paragraph, the plurality of mold cavities 24, which may be formed on the drum 14, is provided, and the panel 122 having an opening 120 is provided. The panel 122 is positioned above the mold cavities 24 and the opening 120 is aligned with adjacent or corresponding ones of the mold cavities. In an embodiment, positioning the panel 122 above the adjacent ones of the mold cavities 24 includes adjusting a height of the panel above the mold cavities to a selected spacing between the panel and the mold cavities using the adjusting chains 130, 132 and 140, 142. A sheet 58 of mesh material is placed between the panel 122 and the mold cavities 24, and a hardenable paste 25 is deposited through the opening 120 and into the mold cavities such that the sheet of mesh material becomes embedded in the hardenable paste over the mold cavities. The hardenable paste 25 is allowed to harden into blocks 76 held together by the sheet 58 of mesh material, thereby forming the flexible mat 74, which in embodiments consists of or comprises a tied block mat. The flexible mat 74 is then removed from between the panel 122 and the mold cavities 24.

Figure 8:
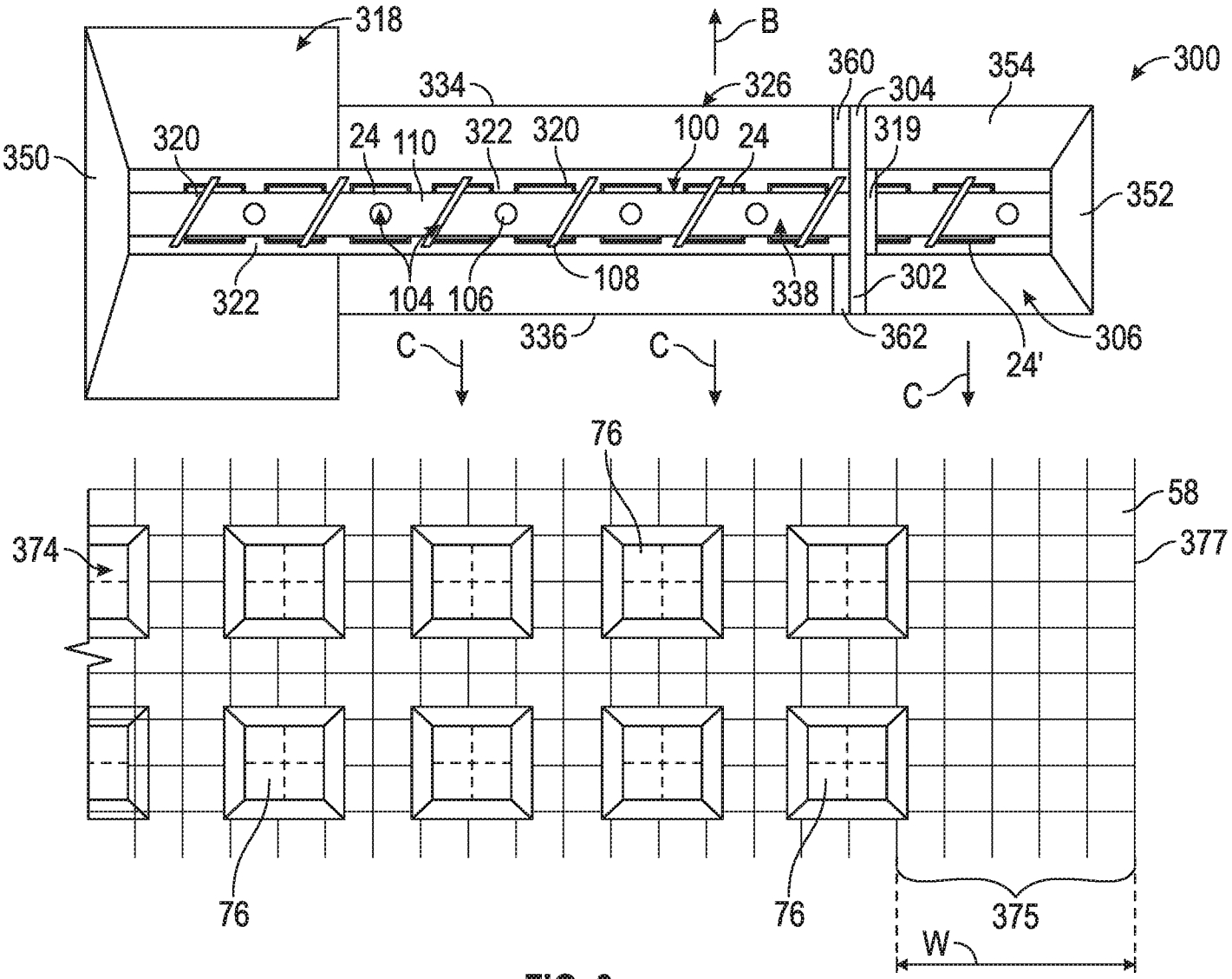
FIG. 8 is a schematic top plan view of another embodiment of the system in which the hopper of the system of FIG. 1 includes a retaining wall, and a sheet of tied block mat with a border.
Figure 10:
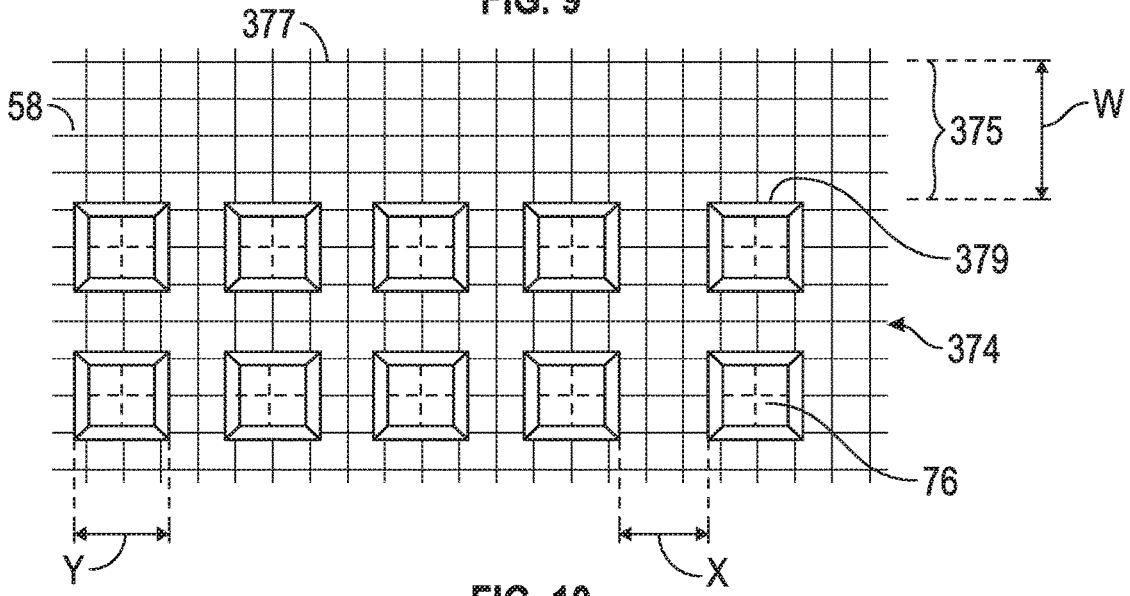
FIG. 10 is a top plan view of tied block mat with a longitudinal border.

Another embodiment of the disclosed system, generally designated 300 and shown in FIGS. 8 and 10, is used to make tied block mat 374 with a border 375. In the embodiment of the mat 374 shown, the border 375 extends longitudinally along an outer edge of the mat. The structure and operation of the system 300 is similar to the system 10 described supra and shown in FIGS. 1-7 in all respects, except as otherwise described below. For example, the system 300 includes a mold or form having an array of mold cavities, which in embodiments takes the form of a rotating drum 14 (see FIG. 1) having a plurality of mold cavities 24 about an outer periphery thereof and mounted on a frame 12. In an embodiment, as shown in FIG. 1 rotation of the mold or drum 14 in the direction of arrow A causes the system 300 to move in the direction of arrow B in FIG. 8, as the tied block mat 374 leaves the system in the direction of arrow C.

A hopper 326 is positioned adjacent the mold or drum 14 and is spaced from the mold sufficiently to receive a sheet of mesh material 58 therebetween. In an embodiment, the hopper 326 is shaped to receive a hardenable paste 25 in a filling zone 318 and includes an openings 320, which may take the form of a continuous opening, for depositing the hardenable paste into selected mold cavities 24 of the array of mold cavities facing the hopper as the drum 14 rotates relative to the hopper. The hopper 326 has opposing end walls 350, 352 defining ends of the hopper. In an embodiment, the hopper 326 forms a blocked zone 306 with the mold or drum 14 where the hardenable paste 25 in the hopper 326 is prevented from entering other selected mold cavities 24' of the mold. As will be described in greater detail below, in an embodiment the tied block mat 374 is formed wherein the hardenable paste 25 in the selected mold cavities 24 becomes embedded in the sheet of mesh material in the filling zone 318, and a border 375 is formed in the blocked zone 306 where the hardenable paste is blocked from entering the other selected mold cavities 24', so that blocks 76 of hardened paste are not formed on the sheet of mesh material 58.

The hopper 326 includes an opening 320, which in embodiments takes the form of a series of rectangular openings formed in the bottom panel 322 of the hopper 326. In embodiments, the openings 320 are shaped and positioned to align with the mold cavities 24 facing the hopper. In other embodiments, the opening 320 takes the form of a continuous slot. In either embodiment, the opening or openings 320 align with successive ones of the mold cavities 24 as the drum 14 rotates.

In an embodiment, a retaining wall 302 has a periphery 304 that conforms to an inner profile of the interior chamber 354 of the hopper 326. The retaining wall 302 extends across a width of the hopper 326 between front and rear walls 334, 336, respectively (see also FIG. 9), and is mounted within the hopper between the end walls 350, 352 to block the a flow of the hardenable paste 25 such that the hardenable paste cannot flow into selected ones of the mold cavities 24 in a blocked zone 306. In the embodiment shown in FIGS. 8 and 13, the retaining wall 302 creates the blocked zone 306, which is between the retaining wall and the end wall 352, that in embodiments will not receive hardenable paste 25 that is deposited between the retaining wall and the end wall 350, which in embodiments is the filling zone 318 of the hopper 326.

As with the embodiment of FIGS. 1-7, the sheet of mesh material 58 is fed between the hopper 326 and the mold cavities 24 facing the hopper (see FIGS. 6 and 7). In some embodiments, the sheet of mesh material 58 has a width corresponding to, or approximately the same as, a width of the hopper 325 between the end walls 350, 352. In other embodiments, the sheet of mesh material 58 is wider than the hopper 326, and/or extends beyond the end wall 352B (see FIG. 15).

In embodiments, the hopper 326 includes a bottom panel 322 having an arcuate shape corresponding to a curvature of the rotating drum 14. The bottom panel 322 includes the opening or openings 320 shaped such that hardenable paste 25 deposited into the hopper 326 flows through the openings in the filling zone 318 to fill the adjacent, facing mold cavities 24 between a selected end wall 350 and the retaining wall 302. In embodiments, the hardenable paste 25 is selected from a fresh cement paste, optionally wet-cast Portland cement, concrete, a mixture of Portland cement, sand, and/or gravel, and a polymer. In embodiments, the mesh material 58 is a geogrid.

In an embodiment wherein the mold is a rotating drum 14, the sheet of mesh material 58 is fed between the hopper 326 and the rotating drum such that the sheet becomes embedded in the hardenable paste 25 deposited into the mold cavities 24 in the filling zone 318 to form tied blocks. A border without the tied blocks is formed on a strip 375 of the sheet of mesh material passing beneath the blocked zone 306.

In an exemplary embodiment, the system 300 further includes an auger 100, positioned in a central section 338 of the hopper 326. The auger 100 rotates to distribute the hardenable paste 25 along a length of the hopper. As shown in FIG. 1, in embodiments, the system 300 includes a motor 102 (see FIG. 1) that rotates the auger 100 within the hopper 326. In embodiments, the auger 100 is co-extensive with the opening 320 (which may take the form of a row of openings) in the bottom panel 322 of the hopper 326, and extends a length of the hopper between, and is rotatably mounted in, the opposing end walls 350, 352, through both the filling zone 318 and the blocked zone 306. In embodiments, the auger 100 includes a plurality of radially extending protrusions, generally designated 104, along its length that distribute the hardenable paste 25 along the width of the hopper 326.

Figure 13:
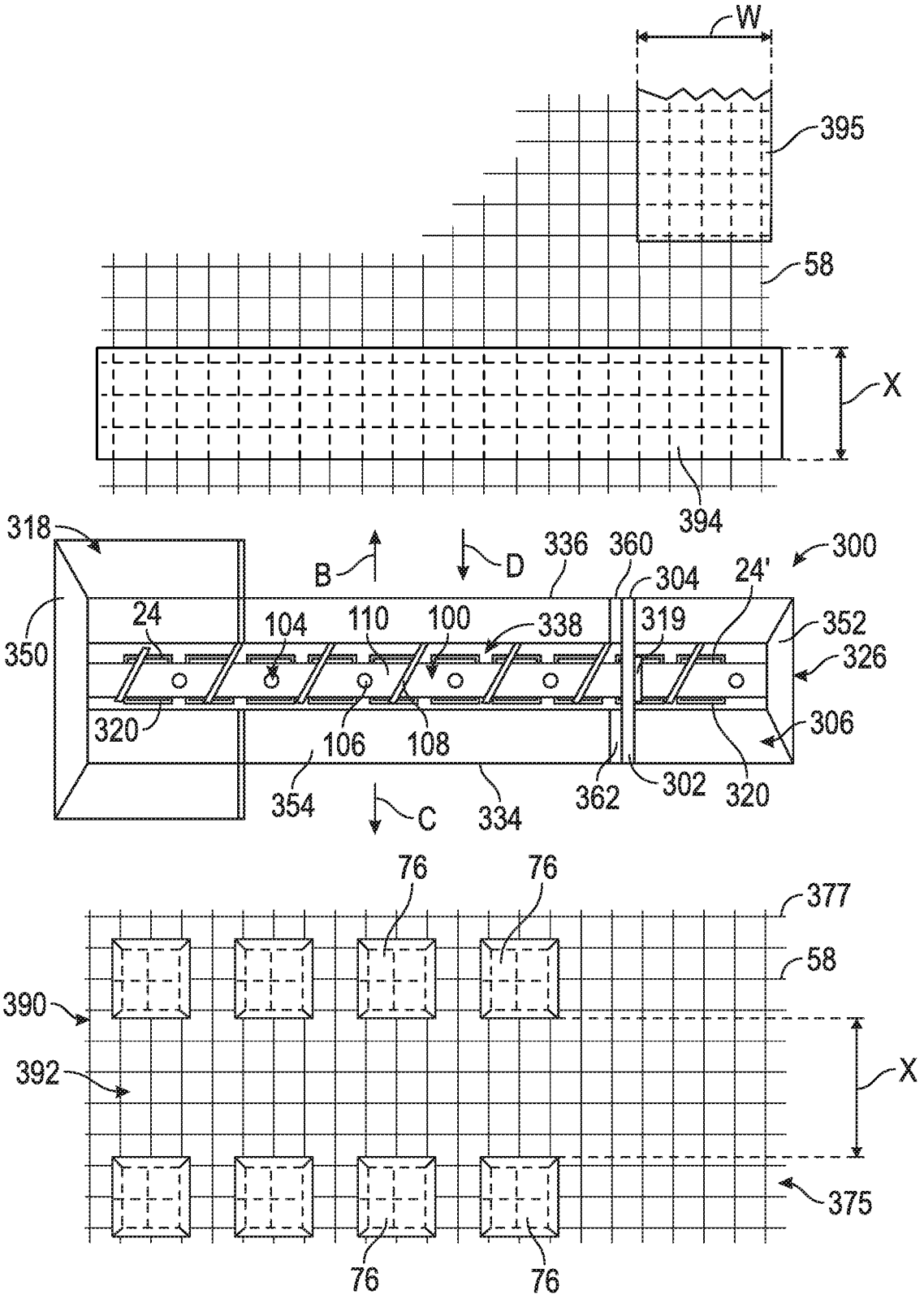
FIG. 13 is a schematic top plan view of another embodiment of the system of claim 8, and optionally FIG. 1, in which a mask is placed over the incoming sheet of grid material to create a gap of predetermined length between adjacent rows of block.

In embodiments, the auger 100 includes a central shaft 110, and the protrusions 104 are selected from rods 106 and paddles 108 that extend radially, and in embodiments orthogonally, from the central shaft 110. In embodiments, the protrusions 104 are spaced about the periphery of the central shaft 110. As shown in FIGS. 8 and 13, in embodiments, auger 100 extends through the retaining wall 302.

Figure 9:
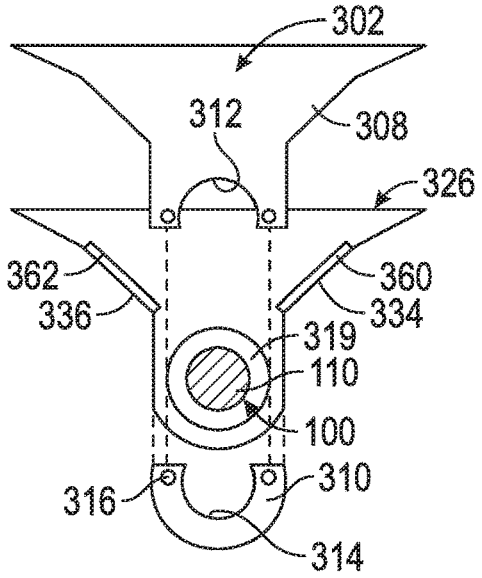
FIG. 9 is a front elevation of an embodiment of the retaining wall of the hopper of FIG. 8.

As shown in FIG. 9, in embodiments, the retaining wall 302 includes an upper segment 308 shaped to conform to a profile of an upper portion of the inner surface of the hopper 326, for example, as defined by front and rear walls 334, 336, respectively, and a complementary lower segment 310 shaped to conform to a lower portion of the inner surface of the hopper. The upper segment 308 includes an arcuate cutout 312, and the lower segment includes an arcuate cutout 314. Arcuate cutouts 312, 314 are shaped to follow the curvature and radius of, and thus fit closely to, the outer periphery of the central shaft 110 of the auger 100.

In embodiments, the upper segment 308 and the lower segment 310 are connected by fasteners 316, which may take the form of rivets, nut and bolt combinations, and the like. In an exemplary embodiment, the retaining wall 302 is removable from the hopper 326, thus eliminating the blocked zone 306. In an embodiment, the upper and lower segments 308, 310, respectively, are detachable from each other to facilitate removal from around the central shaft 110 and from the hopper 326. Alternately, or in addition, the segments 308, 310 are connected to each other about the central shaft 110 by weldment or adhesive.

As shown in FIGS. 8, 9, and 10, in an exemplary embodiment of the system 300, the central shaft 110 includes a radially extending collar 319 positioned adjacent the retaining wall 302 to form a seal or barrier with the retaining wall about the central shaft. The collar 319 may be made of steel, stainless steel, aluminum, or other corrosion-resistant material, and in embodiments is attached to the central shaft 110 by one or more of screws, welding, brazing, and/or an adhesive. In embodiments, the hopper 326 includes ribs 360, 362, attached to and extending from the inner surface of the front and rear walls 334, 336, respectively, of the hopper. The ribs 360, 362 may take the form of steel bars or rods that are welded, bolted, brazed, adhered, or otherwise fixed to the interior surfaces of the front and rear walls 334, 336, respectively, of the hopper 326. In embodiments, the ribs 360, 362 are aligned orthogonally with a central axis of the central shaft 110 of the auger 100 and are directly opposed to each other. In embodiments, the retaining wall 302 is attached to the ribs 360, 362 by welding, brazing, adhesives, and/or fasteners such as rivets and/or nut and bolt combinations. In other embodiments, the retaining wall 302 is held in place without attachment but is sandwiched between the ribs 360, 362 on one side, and the collar 319 on the opposite side.

The foregoing description of the system 300, shown in FIGS. 8-13, used to manufacture a flexible mat, which may take the form of tied block mat 374 shown in FIGS. 8, 10, 11, 12, and 13. In embodiments, the tied block mat 374 includes a sheet 58 of grid material and a plurality of blocks 76 of hardened material connected to the sheet. The blocks 76 are arranged on the sheet 58 to form a strip 375 of the sheet 58 of grid material that is free of the blocks. In embodiments, the sheet 58 is oblong in shape, and the strip 375 is located along a longitudinal or lengthwise edge 377 of the sheet. In an embodiment, the longitudinal strip 375 of the sheet 58 has a width W of at least a width Y (FIG. 10) of one block 76, and in other embodiments, the width of the spacing of two or three blocks 76. The width W is measured from an outer edge 379 of the block 76 adjacent the strip 376 to an outer longitudinal edge 377 of the sheet 58, as shown for example in FIGS. 8 and 10.

In another embodiment, the tied block mat 390 shown in FIG. 13 includes blocks 76 cast into the sheet 58 in a pattern that forms a transverse gap 392 between rows of the blocks on the sheet of tied block mat 390. The gap 392 has a width X that in embodiments is as wide as a single block 74, and in other embodiments may be greater than the width of a single block, such as two or more blocks. The width X is measured from the edges of adjacent blocks 76, or the row of blocks, adjacent the gap 392. The function of the gap 392 is to provide an area where a sheet 390 may be separated transversely to form two separate sheets, where one of the separate sheets, and in an embodiment each of the separate sheets, has a strip with a width of at least one block 76.

A method for making tied block mat 374 with a border is shown in FIGS. 1 and 8. A sheet of mesh material 58 is placed over a mold 14 having an array of mold cavities 24. A hardenable paste 25 is deposited into the hopper 326 that is spaced from the mold sufficiently to receive the sheet of mesh material therebetween. The hardenable paste 25 is deposited through the opening 320 in the hopper 326 into selected mold cavities 24 of the array of mold cavities in the filling zone 318. The hardenable paste 25 is prevented from entering other selected mold cavities 25 in the blocked zone 306. The sheet of mesh material 58 is embedded in the hardenable paste 25 in the selected mold cavities in the filling zone 318. The border 375 in the blocked zone 306 where the hardenable paste 25 is prevented from entering the other selected mold cavities 24. The hardenable paste 25 is hardened into blocks 76 to form the tied block mat 390.

In an embodiment, a mold having an array of mold cavities, which in some embodiments is the drum 14 having a plurality of mold cavities 24 about an outer periphery thereof is rotated, in embodiments by motor 102, and/or in other embodiments by being pulled along the ground 66 by a tractor 200. A hardenable paste 25 is deposited into the hopper 326 positioned adjacent the drum 14 from chute 27 (FIG. 1). The hopper 326 is shaped to receive the hardenable paste 25 and deposit the hardenable paste through the opening 320 into successive mold cavities 24 of the plurality of mold cavities facing the hopper as the drum 14 rotates relative to the hopper.

The flow of the hardenable paste 25 along the hopper 326, assisted by the auger 100, is blocked by the retaining wall 302 such that the hardenable paste cannot flow into selected ones of the mold cavities. In the embodiment of FIG. 9, the hardenable paste 25 cannot flow into the area 306 between the retaining wall 302 and the end wall 352. In embodiments, a sheet of mesh material 58 is fed between the hopper 326 and the mold cavities 24 facing the hopper, best shown in FIG. 1. In embodiments, the sheet of mesh material 58 has a width corresponding to a width of the hopper between the end walls 350, 352.

The hardenable paste 25 hardens into blocks 76 within the cavities 24 as the drum 14 continues to rotate. The sheet of mesh material 58 becomes embedded in the hardened blocks 76 to form the tied block 374 mat having a border 375 of mesh material 58 without the blocks, which results from blocking of the flow of the hardenable paste 25 into the selected ones of the mold cavities 24 in the area 306.

In the embodiment shown in FIG. 8, the border 375 is along a longitudinal edge of the mat 374. Also in that embodiment, the retaining wall 302 is positioned within the hopper 326 such that the border 375 has a width of at least one of the blocks 76. In an embodiment, the flow of hardenable paste 25 into the blocked area 306 is prevented by placing the retaining wall 302 having a periphery 304 that conforms to an inner profile of the hopper 326 and extends widthwise across front and rear walls 334, 336 of the hopper and is positioned between the end walls 350, 352. Also in embodiments, depositing the hardenable paste 25 into the hopper 326 includes distributing the hardenable paste along a length of the filling zone 318 of the hopper by the auger 100 between an end wall 350 of the hopper and the retaining wall 302.

In one exemplary embodiment, a method for making tied block mat 390 with a transverse gap 392 is shown in FIGS. 1 and 8. The method includes rotating drum 14 having a plurality of mold cavities 24 about an outer periphery thereof, and depositing the hardenable paste 25 into the filling zone 318 of the hopper 326 positioned adjacent the drum. The hopper 326 is shaped to receive the hardenable paste 25 and deposit the hardenable paste through the opening 320 into successive mold cavities 24 in the filing zone 318 of the plurality of mold cavities facing the hopper as the drum 14 rotates relative to the hopper.

In an embodiment of the system 300 shown in FIG. 13, a sheet of mesh material 58 is fed between the hopper 326 and the mold cavities 24 facing the hopper. In embodiments, the sheet of mesh material 58 has a width corresponding to, or approximating, the width of the hopper 326 between the end walls 350, 352. The sheet of mesh material 58 is selectively masked as the mesh material passes between the hopper 326 and the mold cavities 24, thereby preventing the hardenable paste 25 in the hopper from entering the mold cavities. This masking forms the blocked zone 306 on the sheet of mesh material 58. The hardenable paste 25 deposited in the filling zone 318 flows through the opening or openings 320 and into the cavities 24 that are not masked and hardens into blocks 76 to form the tied block mat 390 having a gap 392 of width X between the blocks extending transversely of the sheet of mesh material 58 without the blocks 76 formed by masking of the flow of the hardenable paste 25 into the selected ones of the mold cavities 24.

In an embodiment shown in FIG. 13, selectively masking the sheet of mesh material 58 includes placing a plate 394 across a width of the sheet of mesh material 58 upstream of the hopper 326. In embodiments, the plate 394 may extend the entire width of the sheet of mesh material 58. In embodiments, the plate 394 may be rigid and made of a sheet of metal such as steel or aluminum, or wood such as plywood or a composite material. In other embodiments, the plate 394 is flexible, such as a sheet of polymer, plastic, heavy paper, or metal foil. In some embodiments, the plate 394 is simply manually placed on the sheet of mesh material 58 upstream of the hopper 326. In other embodiments, the plate 394 is attached to the sheet of mesh material 58 by fasteners or an adhesive, and is coiled in the roll 60 of mesh material 58 and held in the spool assembly (see FIG. 1). In an embodiment, the sheet of tied block mat 394 may be made with or without the strip 375, simply by installing or removing, respectively, the retaining wall 302 from the hopper 326. In embodiments, the plate 394 extends transversely of the sheet of mesh material 58; that is, orthogonal to longitudinal edge 377. In other embodiments, the plate 394 is placed at an angle other than orthogonal to longitudinal edge 377, such as diagonal.

Also shown in FIG. 13, alternatively, or in addition, selectively masking the sheet of mesh material 58 includes placing a plate 395 includes placing a plate 395 along a longitudinal length of the sheet of mesh material. The plate 395 covers a strip of the mesh material 58 having a width W. As with the plate 394, in embodiments the plate 395 is rigid and made of a sheet of metal such as steel or aluminum, or wood such as plywood or a composite material. In other embodiments, the plate 395 is flexible, such as a sheet of polymer, plastic, heavy paper, or metal foil. In operation of the system 300, the plate 395 passes between the hopper 326 and the drum 14 (FIG. 1) and blocks the flow of cement paste 25 through the openings 320 from the hopper into the mold cavities 24 as the mold cavities pass beneath and align with the openings. The resultant tied block mat 390 lacks blocks 76 on the sheet of mesh material 58 in the area covered by the plate 395. In such embodiments, use of the retaining wall 302 is not required; the blocked zone 306, in which hardenable paste is prevented from flowing into cavities 24', is instead created by the plate 395.

In some embodiments, the plate 395 is simply manually placed on the sheet of mesh material 58 upstream of the hopper 326. In other embodiments, the plate 395 is attached to the sheet of mesh material 58 by fasteners or an adhesive, and is coiled in the roll 60 of mesh material 58 and held in the spool assembly 56 (see FIG. 1). In embodiments, the plate 395 is coextensive in length with the sheet of mesh material 58. In other embodiments, the plate 395 is shorter in length, or several plates are spaced along the length of the sheet of mesh material. In an embodiment, the plate 395 is placed adjacent and parallel to the longitudinal edge 377 of the sheet of mesh material 58, as shown in FIG. 13. In other embodiments, the plate 395 is placed on the sheet of mesh material 58 spaced from and parallel to longitudinal edge 377, or spaced from and oblique to the longitudinal edge.

As shown in FIG. 13, in an embodiment the sheet of mesh material 58, with mask plate 394 and/or mask plate 395, is payed off roll 60 of spool assembly 56 (FIG. 1) toward the hopper 326 in the direction of arrow D, while the drum 14 rotates as the system 300 moves in the direction of arrow B. The completed tied block mat 390, with gap 392 and/or gap 375, leaves from below the drum in the direction of arrow C. In the embodiment of FIG. 1, the tied block mat 390 is static on a support surface such as the ground 66 as the system 300 moves away from it in the direction of arrow B.

Figure 14:
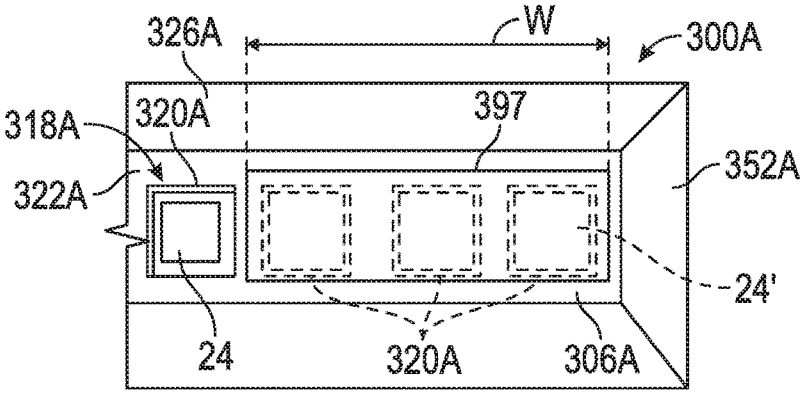
FIG. 14 is a detail showing the hopper of another embodiment of the disclosed system for making tied block mat with a border, in which a portion of the bottom panel is masked to cover selected openings.
Figure 15:
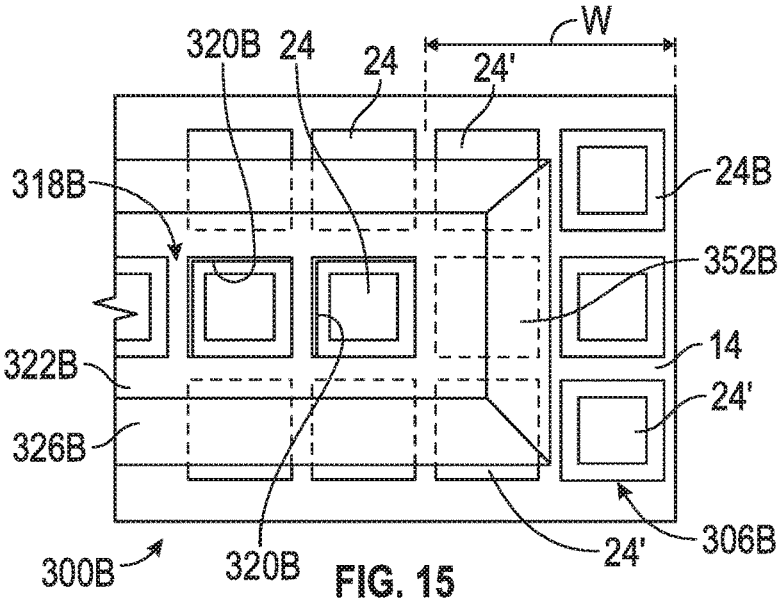
FIG. 15 is a detail showing the hopper of another embodiment of the disclosed system for making tied block mat with a border, in which the hopper is shorter in length than the drum.
Figure 16:
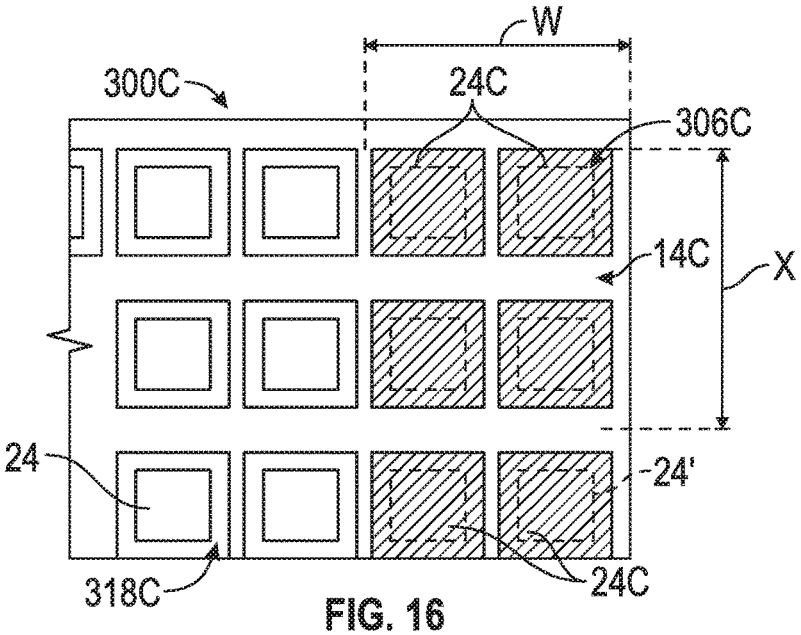
FIG. 16 is a detail showing the drum of another embodiment of the disclosed system for making tied block mat with a border, in which the cavities on the edge of the drum are capped.

FIGS. 14, 15, and 16 each show other embodiments of the system 300A, 300B, and 300C for making tied block mat 374 (FIG. 8) with border 375 without use of the retaining wall 302 structure shown in FIGS. 8, 9, and 13. All other components of the systems 300A, 300B, 300C are the same as illustrated in FIGS. 1-8 and described herein with reference to those Figures (the auger 100 is removed for clarity from FIGS. 14 and 15).

In the system 300A depicted in FIG. 14, the hopper 326A includes a bottom panel 322A in which the end ones of the openings 320A are covered by a mask 397 that blocks the flow of hardenable paste 25 (FIG. 1) from the hopper 326A through the end ones of the openings forming a blocked zone 306A. The openings 320A in the hopper 326A not covered form the filling zone 318A. The mask 397 is selected to lie over the bottom panel 322A and cover enough openings 320A to create a strip 375 of width W on the longitudinal edge of the tied block mat 374 (FIG. 8) by blocking flow of hardenable paste 24 from the hopper 326A into cavities 24'. The remaining openings 320A of the filling zone 318A are over cavities 24 of the drum 14 and allow hardenable paste 25 deposited in the hopper 326A to flow into the cavities to form the hardened blocks 76 of the tied block mat 374 of FIG. 8. The cavities 24' blocked by the mask 397 do not receive hardenable paste and form the gap 375 of the tied block mat 374.

In embodiments, the mask 397 is rectangular and plate shaped to fit over a selected length of the bottom panel 322A of the hopper 326A, for example adjacent end wall 352A as shown, thereby covering the three openings 320A immediately adjacent the end wall. In embodiments, the mask 397 is rigid and made of a sheet of metal such as steel or aluminum, or wood such as plywood or a composite material. In other embodiments, the plate 395 is flexible, such as a sheet of polymer, plastic, heavy paper, metal foil, or combinations thereof. In embodiments, the mask 397 is fixed to the bottom panel 322A by welding, rivets, or by bolts or screws, in which case the mask is selectively removable. In other embodiments, the mask 397 is placed on the bottom panel 322A of the hopper 326A at a location not adjacent the end wall 352A, for example anywhere along the length of the hopper between the end walls. In still other embodiments, multiple masks 397 are placed in the hopper 326A to cover selected ones of the openings 320A in the bottom panel, and in embodiments are spaced from each other. In embodiments, the mask 397 is placed in the filling zone 318 of the hopper (FIGS. 8 and 13) beneath the auger 100, and is adjacent end wall 350.

In the embodiment of the system 300B shown FIG. 15, the hopper 326B has a length, measured in a direction parallel to a central axis of the cylindrical drum 14, that is less than a width of the drum (see also FIGS. 1 and 4). The two end columns of end mold cavities 24B on the drum 14 (i.e., the two circular arrays of mold cavities extending about the periphery of the drum immediately adjacent the end wall 352B of the drum) extend beyond the openings 320B adjacent the end wall 352B of the hopper 326B. Thus, the portion of the drum 14 extending beyond the end of the hopper 326B is the blocked zone 306B, while the entirety of the hopper 326B forms the filling zone 318B that receives hardenable paste 25.

Rotation of the drum 14 beneath the hopper 326B during operation of the system 300B does not bring the end mold cavities 24' of these two end columns beneath any of the openings 320B in the bottom panel 322B of the hopper 326B. Consequently, the end mold cavities 24' do not receive hardenable paste from the hopper 326B and the sheet of mesh material 58 (FIG. 8) passing over the drum at the end cavities 24B does not receive hardenable paste 25, leaving a strip 375 on the tied block mat 374, as shown in FIG. 8.

In the embodiment of the system 300C shown in FIG. 16, the drum 14C includes covers 24C that attach to the drum and seal or close the adjacent mold cavity 24. In embodiments, the covers 24C are shaped to fit within the mold cavities 24 in the form of a plug. In other embodiments, the covers 24C do not extend into the mold cavities 24 and completely cover the mold cavity openings. In embodiments, the covers are made of metal, wood, plastic, or paper, and are attached to the drum 14 by welding, brazing, adhesive, screws, such as set screws, or spring detents.

As shown in FIG. 16, in an embodiment, the covers 24C are placed over the endmost columns of mold cavities 24' of the drum 14C to form the blocked zone 306C that forms the strip 375 of the tied block mat 374 shown in FIG. 8 from operation of the system 300C. The remaining mold cavities 24 are in the filling zone 318C and pass beneath and receive hardenable paste 25 from the hopper 326 (see FIG. 8, optionally with the retaining wall 302 removed) to form the blocks 76 of the tied block mat 374. In other embodiments, the covers 24C are placed over other mold cavities 24', and are arranged in transverse rows and/or longitudinal columns (i.e., in circles on the periphery of the drum 14C) to form blocked zones 306C of different strip configurations, including diagonal. When the drum 14C rotates beneath the hopper, such as hopper 26 in FIG. 1, hardenable paste 25 is blocked by the covers 24C from flowing from the hopper into the mold cavities 24' closed by the covers in the blocked zone 306C. In embodiments, the covered cavities 24 are arranged to form the strip 375 along a longitudinal edge of the sheet of tied block mat 274 (FIG. 8) of width W, and/or a transverse strip 392 of width X.

Figure 11:
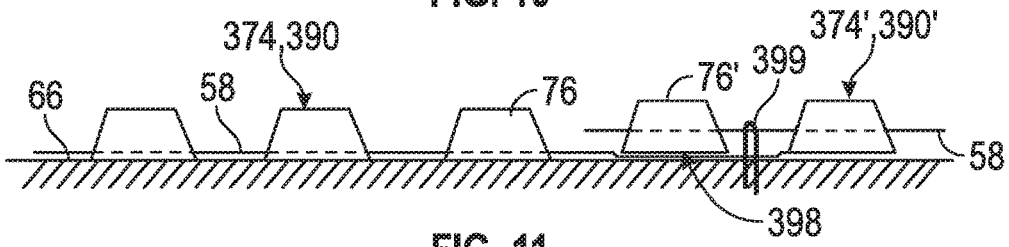
FIG. 11 is a detail side elevation of adjacent sheets of tied block mat in which one sheet of tied block mat overlies the longitudinal border of an adjacent sheet of tied block mat.

The sheets of tied block mat 374, 390 may be connected as shown in FIG. 11. A first sheet of tied block mat, 374, 390 and a second sheet of tied block mat 374',390' are selected, each having a sheet of grid material 58 and a plurality of blocks 76 of hardened material connected to or embedded in the sheet. If tied block mat 390 is selected, the mat is cut along the transverse gap 392 to form a strip 396. The blocks 76 on the first sheet 374, 390 are arranged thereon to form a longitudinal strip 375 or transverse strip 396 along an edge of the first sheet that is free of the blocks.

The first sheet 374, 390 is placed on a support surface 66, which in embodiments is the ground at the location of installation. The second sheet 374',390' is placed on the support surface 66 adjacent the longitudinal strip 375 or transverse strip 396 of the first sheet 374, 390 such that an edge of the second sheet 374',390' overlies the strip of the first sheet so that ones of the blocks 76' of the second sheet are positioned above, and rest upon, the strip of the first sheet to form an overlapping region 398. In embodiments, this overlapping region 398 extends the entire length, or substantially the entire length, of the adjacent sheets of tied block mat 374, 390, 374',390', thus connecting the sheets together.

In embodiments, the second sheet 374',390' is mechanically connected to the first sheet 374, 390 at the overlapping region 398. In embodiments, the sheets 374, 390, 374',390' are connected by one or more of stapling the second sheet to the first sheet by fasteners 399. In embodiments, the fasteners 399 take the form of cable ties tying the sheet 374, 390 to the first sheet 374',390', made of stainless steel or nylon, and/or staking the second sheet and the first sheet to the support surface 66, in which case the fastener takes the form of an inverted U-shaped anchors.

In embodiments, the sheets of grid material 58 of the first and second sheets 374, 390, 374',390' are selected from a geogrid material. In embodiments, the hardened material of the blocks 76 of the first and the second sheets 374, 390, 374',390' is selected from cement, concrete, a polymer, and combinations thereof.

Figure 12:
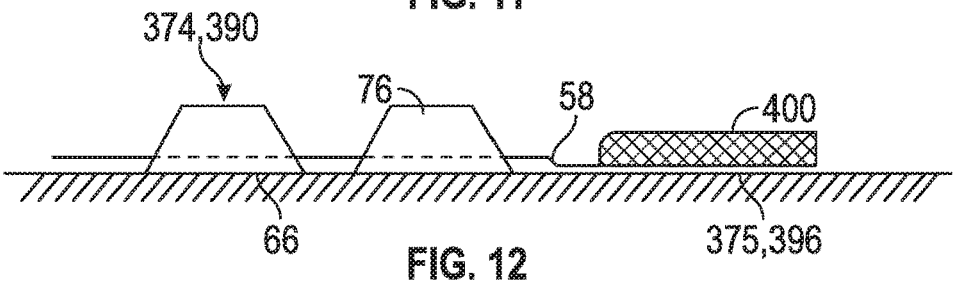
FIG. 12 is a detail side elevation of the disclosed sheet of tied block mat in which the longitudinal border is beneath pavement.

As shown in FIG. 12, the sheets of tied block mat 374, 390 may be secured to pavement 400, which may take the form of asphalt, concrete, pavers, sand, gravel, wood, or combinations of the foregoing, in a similar fashion. The sheets of tied block mat 374, 390 are placed on the support surface 66 such that the strip 375, 396 overlies a region to be covered by the pavement 400. Next, the pavement 400 is applied on top of the strip 375, 396, thereby connecting the sheet of tied block mat 374, 396 to the pavement 400. In embodiments, the sheet of tied block mat 374, 396 also may be secured to the support surface 66 by staking, in embodiments prior to application of the pavement 400.

The foregoing methods and resultant products produce sheets of tied block mat 374, 390 that may be connected to each other with a minimum of effort, and use of strips 375, 396 eliminate the need for digging a trench to receive the blocks 76 of a tied block mat that would lie under the blocks of an adjoining tied block mat. While the methods and forms of apparatus disclosed herein constitute preferred forms of the disclosed flexible mat forming system, it is to be understood that the system and invention are not limited to these precise forms apparatus and methods, and that changes may be made therein without departing from the scope of the disclosure.

What is claimed is:

1. A tied block mat, comprising:

a sheet of open mesh material; and a plurality of imperforate, pyramidal blocks of hardened material embedded in the sheet of open mesh material and arranged thereon and spaced apart from each other to expose the open mesh material of the sheet of open mesh material therebetween and to form a longitudinal strip along an edge of the sheet of open mesh material spaced from an adjacent row of the imperforate, pyramidal blocks of hardened material that is free of the imperforate, pyramidal blocks of hardened material;

wherein the longitudinal strip of the sheet of open mesh material has a width greater than a width of one of the blocks of hardened material such that a longitudinal edge of a first one of the tied block mat can be placed over the longitudinal strip of a second one of the tied block mat so that the imperforate, pyramidal blocks of hardened material of the adjacent row of the first one of the tied block mat completely overlie the longitudinal strip of the second one of the tied block mat and are spaced from an adjacent row of imperforate, pyramidal blocks of hardened material of the second tied block mat to expose the open mesh material of the sheets of grid material of the first and the second tied block mats therebetween in overlapping relation.

2. The tied block mat of claim 1, wherein the sheet of open mesh material is oblong in shape, the edge of the sheet of open mesh material is a lengthwise edge of the sheet of open mesh material, and the longitudinal strip extends along the lengthwise edge of the sheet of open mesh material.

3. A method of connecting first and second sheets of tied block mat, the first sheet of tied block mat having a first sheet of open mesh material and a first plurality of imperforate, pyramidal blocks of hardened material embedded in the first sheet of open mesh material, and the second sheet of tied block mat having a second sheet of open mesh material and a second plurality of imperforate, pyramidal blocks of hardened material connected to the second sheet of open mesh material, the method comprising:

arranging the first plurality of the imperforate, pyramidal blocks on the first sheet of tied block mat and the second sheet of tied block mat such that the imperforate, pyramidal blocks thereof are spaced apart from each other to expose the open mesh material of the first sheet of the open mesh material and the second sheet of the open mesh material therebetween and to form a longitudinal strip along an edge of the first sheet of the open mesh material spaced from an adjacent row of the imperforate, pyramidal blocks of hardened material of the first sheet of tied block mat that is free of the first plurality of the imperforate, pyramidal blocks of hardened material such that a width of the longitudinal strip is greater than a width of blocks in an adjacent row of the second plurality of blocks of the second sheet of tied block mat;

placing the first sheet of tied block mat on a support surface; and placing the second sheet of tied block mat on the support surface adjacent the longitudinal strip of the first sheet of tied block mat such that a longitudinal edge of the second sheet of tied block mat tied block mat is placed over the longitudinal strip of the first sheet one of the tied block mat so that the imperforate, pyramidal blocks of hardened material of the adjacent row of the second sheet of tied block mat completely overlie the longitudinal strip of the first tied block mat and are spaced from an adjacent row of imperforate, pyramidal blocks of hardened material of the first tied block mat to expose the open mesh material of the sheets of open mesh material of the first and the second sheets of tied block mat therebetween in overlapping relation.

4. The method of claim 3, further comprising mechanically connecting the second sheet of tied block mat to the first sheet of the tied block mat at the open mesh material of the sheets of open mesh material of the first and the second sheets of tied block mat in overlapping relation, wherein mechanically connecting is selected from stapling the second sheet of mesh material to the first sheet of mesh material, tying the second sheet of mesh material to the first sheet of mesh material, and/or staking the second sheet of mesh material and the first sheet of mesh material to the support surface.

5. A tied block mat, comprising:

a first sheet of tied block mat having a first sheet of open mesh material and a first plurality of imperforate, pyramidal blocks of hardened material embedded in the first sheet of open mesh material;

a second sheet of tied block mat having a second sheet of open mesh material and a second plurality of imperforate, pyramidal blocks of hardened material embedded in the second sheet of open mesh material;

wherein the first plurality of imperforate, pyramidal blocks is arranged on the first sheet of open mesh material and spaced apart from each other to expose the open mesh material of the sheet of open mesh material therebetween and to form a longitudinal strip along an edge of the first sheet of open mesh material that is free of the first plurality of imperforate, pyramidal blocks, the longitudinal strip being adjacent a first longitudinal row of the first plurality of imperforate, pyramidal blocks; and wherein the second sheet of tied block mat is positioned adjacent the longitudinal strip of the first sheet of open mesh material such that a second longitudinal row of the second plurality of imperforate, pyramidal blocks adjacent an edge of the second sheet of tied block mat overlies the longitudinal strip of the first sheet of tied block mat so that the strip of the first sheet of tied block mat extends beneath an entire width of the blocks of the longitudinal row of the second plurality of blocks to form an overlapping region and are spaced from an adjacent row of imperforate, pyramidal blocks of hardened material of the second tied block mat to expose the open mesh material of the sheets of open mesh material of the first and the second tied block mats therebetween in overlapping relation; and a plurality of fasteners inserted through the open mesh material in overlapping relation thereby connecting the first sheet of open mesh material to the second sheet of open mesh material.

6. The tied block mat of claim 5, wherein the second sheet of open mesh material overlies the first sheet of open mesh material on a side of the longitudinal row of the second plurality of imperforate, pyramidal blocks opposite the first longitudinal row of the first plurality of imperforate, pyramidal blocks.

7. The tied block mat of claim 6, the fasteners that connect the second sheet of open mesh material to the first sheet of open mesh material on the side of the longitudinal row of the second plurality of blocks opposite the first longitudinal row of the first plurality of blocks are selected from cable ties, stakes, and U-shaped anchors.

* * * * *